US011692376B2

(12) United States Patent
Jeong

(10) Patent No.: US 11,692,376 B2
(45) Date of Patent: Jul. 4, 2023

(54) VEHICLE DOOR LATCH WITH SAFETY DEVICE

(71) Applicant: WOOBO TECH CO., LTD., Pyeongtaek-si (KR)

(72) Inventor: Hae Il Jeong, Incheon (KR)

(73) Assignee: Woobo Tech Co., Ltd., Pyeongtaek-si (KR)

( * ) Notice: Subject to any disclaimer, the term of this patent is extended or adjusted under 35 U.S.C. 154(b) by 587 days.

(21) Appl. No.: 16/621,751

(22) PCT Filed: Sep. 9, 2019

(86) PCT No.: PCT/KR2019/011654
§ 371 (c)(1),
(2) Date: Dec. 12, 2019

(87) PCT Pub. No.: WO2020/071651
PCT Pub. Date: Apr. 9, 2020

(65) Prior Publication Data

US 2020/0408007 A1 Dec. 31, 2020

(30) Foreign Application Priority Data

Oct. 2, 2018 (KR) ..... 10-2018-0117552

(51) Int. Cl.
*E05B 81/04* (2014.01)
*E05B 79/20* (2014.01)
(Continued)

(52) U.S. Cl.
CPC ..... *E05B 81/04* (2013.01); *E05B 79/20* (2013.01); *E05B 79/22* (2013.01); *E05B 81/90* (2013.01); *E05B 83/36* (2013.01)

(58) Field of Classification Search
CPC ..... E05B 81/04; E05B 81/06; E05B 81/14; E05B 81/16; E05B 81/25; E05B 81/30;
(Continued)

(56) References Cited

U.S. PATENT DOCUMENTS

2008/0105011 A1 5/2008 Machinda et al.
2015/0233147 A1 8/2015 Martinez et al.
(Continued)

FOREIGN PATENT DOCUMENTS

DE 3150621 A1 * 12/1981 ..... E05B 81/06
JP 2017-193896 A 10/2017
(Continued)

OTHER PUBLICATIONS

Machine translation and numbered paragraphs for WO2017116036A1 (Year: 2017).*
(Continued)

*Primary Examiner* — Christine M Mills
*Assistant Examiner* — Christopher F Callahan
(74) *Attorney, Agent, or Firm* — Sunstein LLP

(57) ABSTRACT

The present invention relates to a vehicle door latch, and more particularly, to a vehicle door latch having a safety device, which is capable of mechanically or electrically preventing an electrical malfunction of the vehicle door latch, installed at the interior or exterior thereof so that safety of the vehicle door latch is improved.

6 Claims, 21 Drawing Sheets

(51) Int. Cl.
*E05B 79/22* (2014.01)
*E05B 81/90* (2014.01)
*E05B 83/36* (2014.01)

(58) Field of Classification Search
CPC ..... E05B 81/34; E05B 81/40; E05B 81/42; E05B 81/76; E05B 81/90; E05B 79/20; E05B 79/22; E05B 85/01; E05B 85/20; E05B 85/24; E05B 85/243; E05B 85/26; Y10T 292/1078; Y10T 292/1082; Y10S 292/23
See application file for complete search history.

(56) References Cited

U.S. PATENT DOCUMENTS

2015/0233452 A1* 8/2015 Martinez ..... F16H 19/04 74/89.14
2015/0308156 A1* 10/2015 Hunt ..... E05B 47/023 292/201
2017/0306662 A1* 10/2017 Och ..... E05B 81/76
2018/0355640 A1* 12/2018 Jeong ..... E05B 79/20

FOREIGN PATENT DOCUMENTS

KR 101308493 B1 9/2013
KR 10-2017-0077443 A 7/2017
KR 10-2018-0020861 A 2/2018
WO WO-2017098563 A1 * 6/2017 ..... B60R 25/24
WO WO 2017/116036 A1 7/2017

OTHER PUBLICATIONS

International Searching Authority/KR, International Search Report and Written Opinion of the International Searching Authority, Application No. PCT/KR2019/011654, dated Dec. 30, 2019, 7 pages.
Japanese Patent Office, Office Action, Application No. 2019-571393, dated Feb. 2, 2021, with English translation, 11 pages.

* cited by examiner

[Fig. 1]
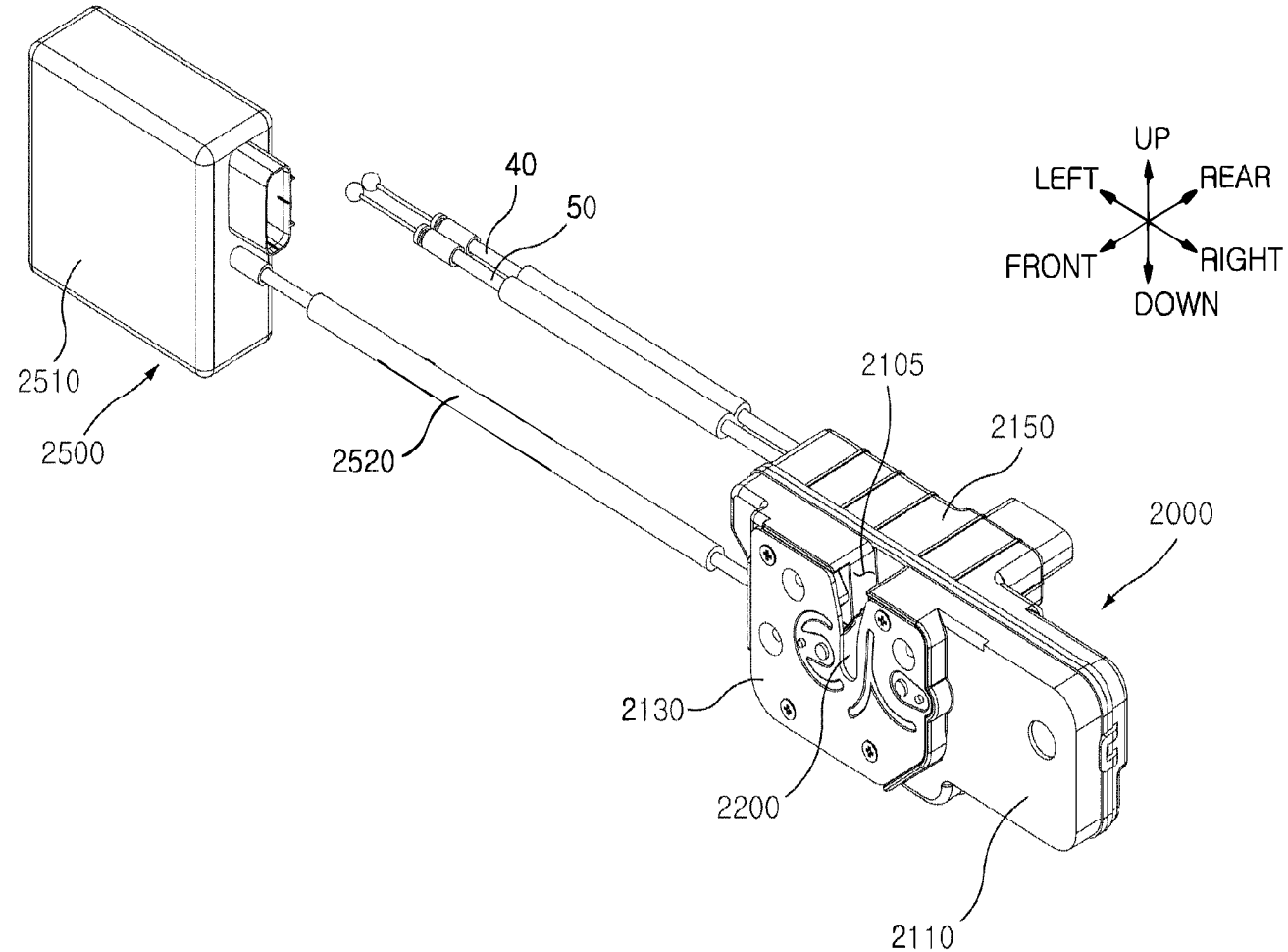

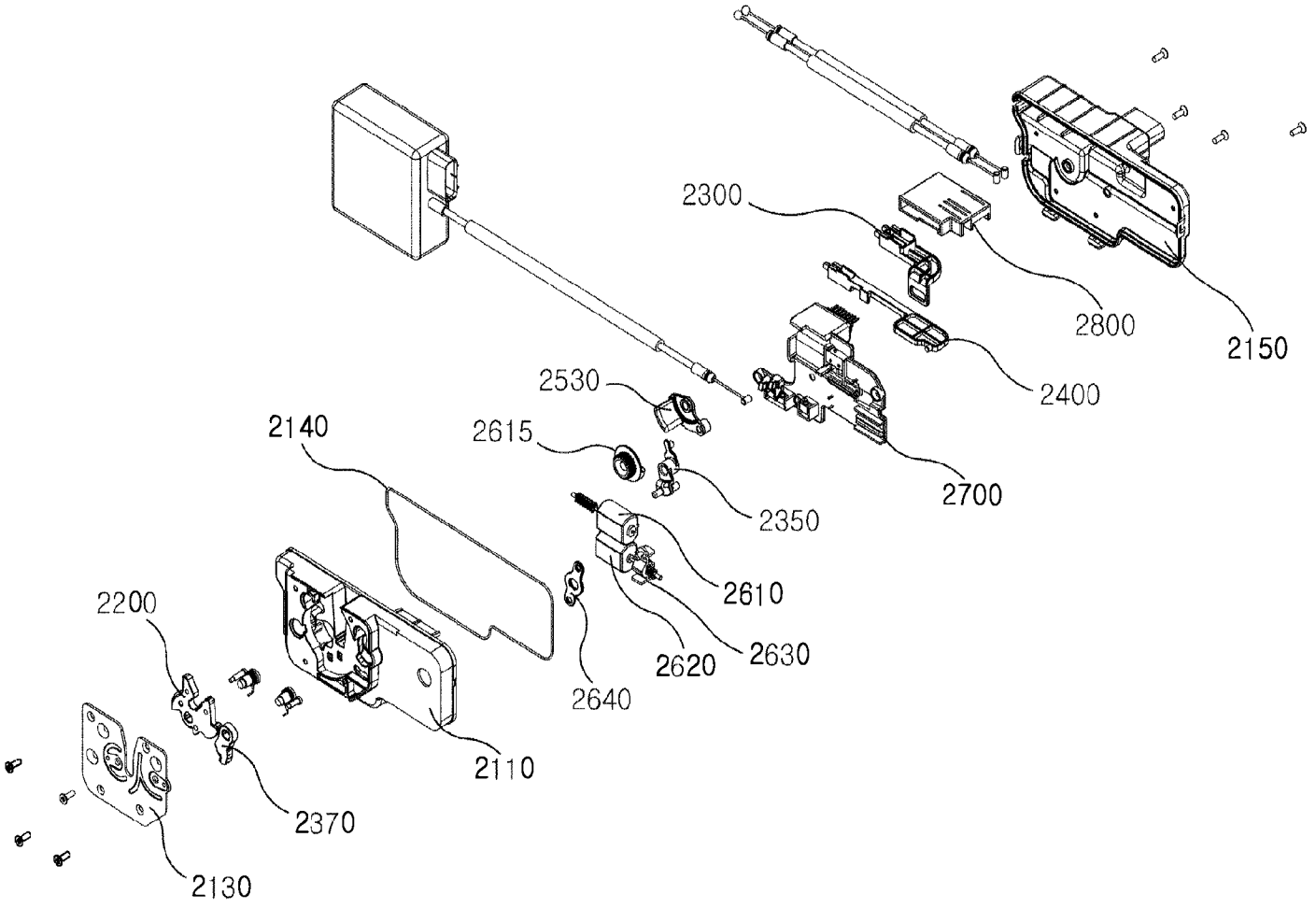
[Fig. 2]

[Fig. 3]
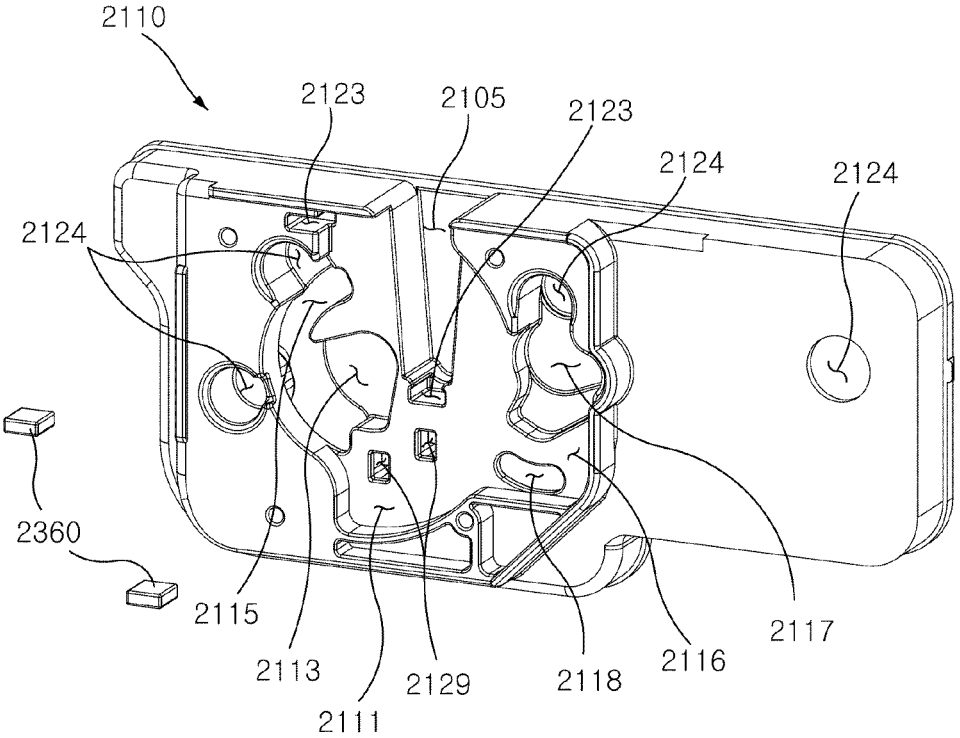
[Fig. 4]
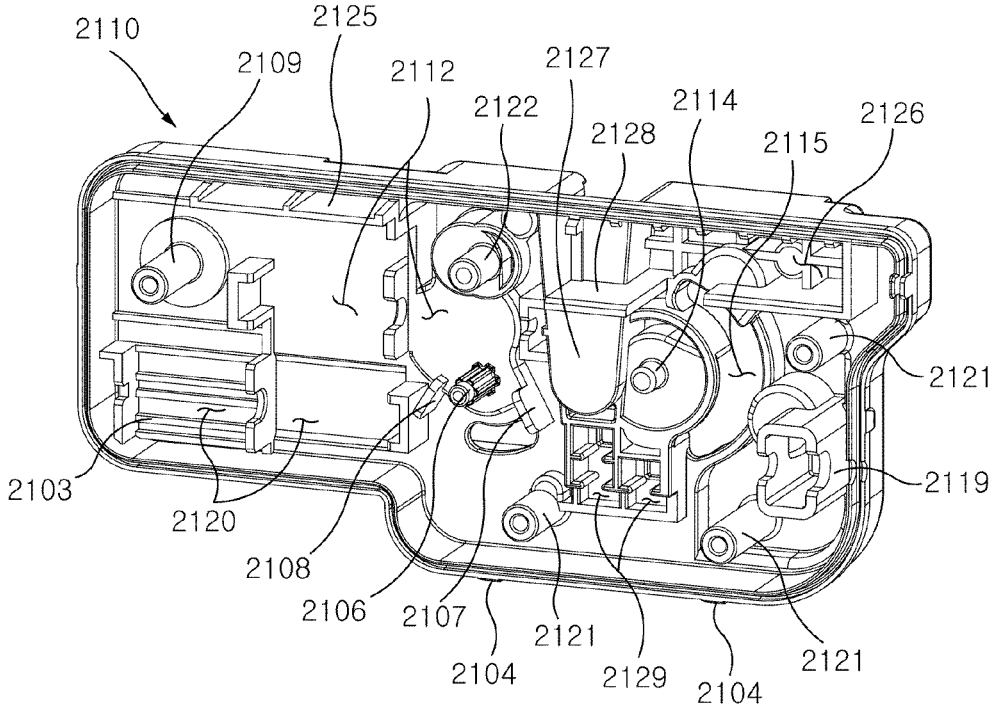

[Fig. 5]
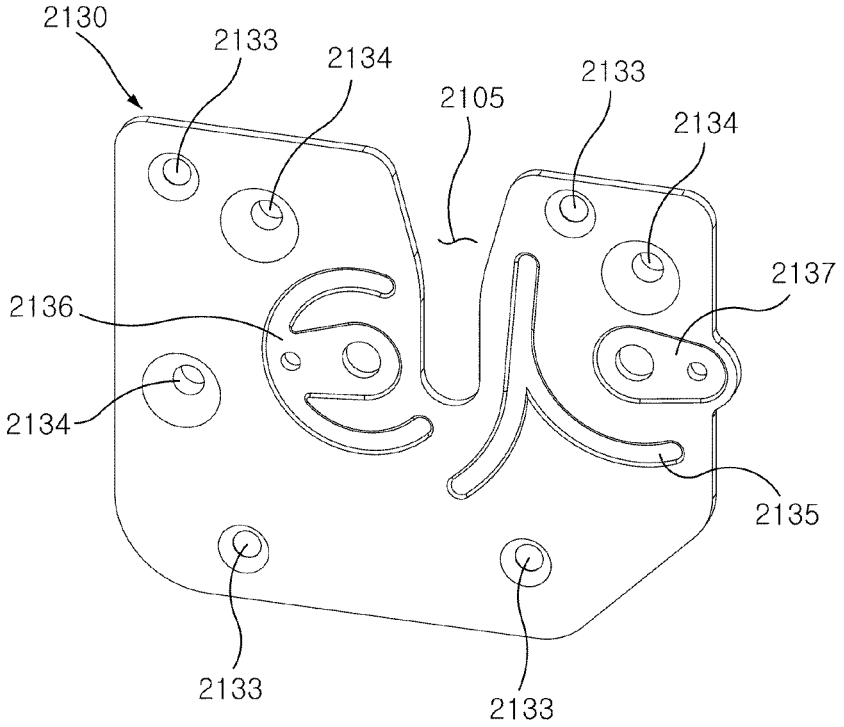
[Fig. 6]
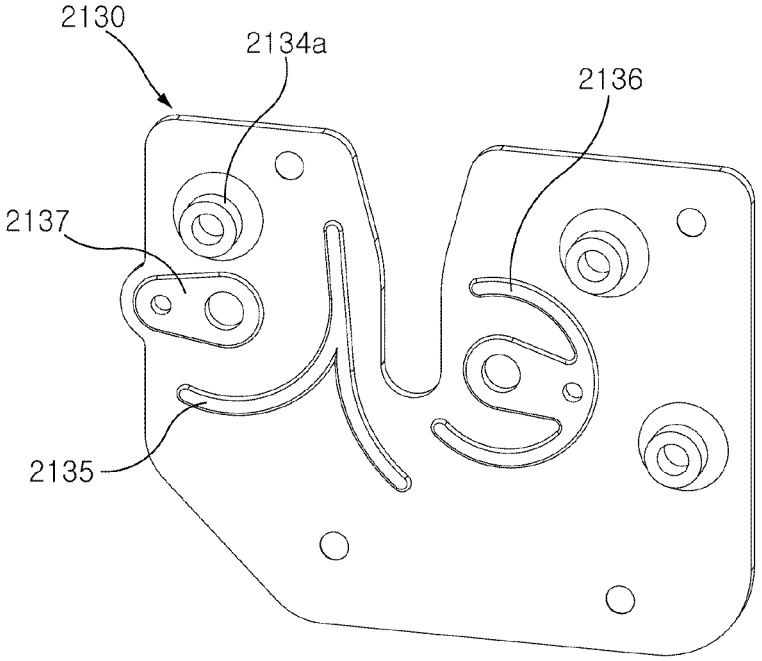

[Fig. 7]
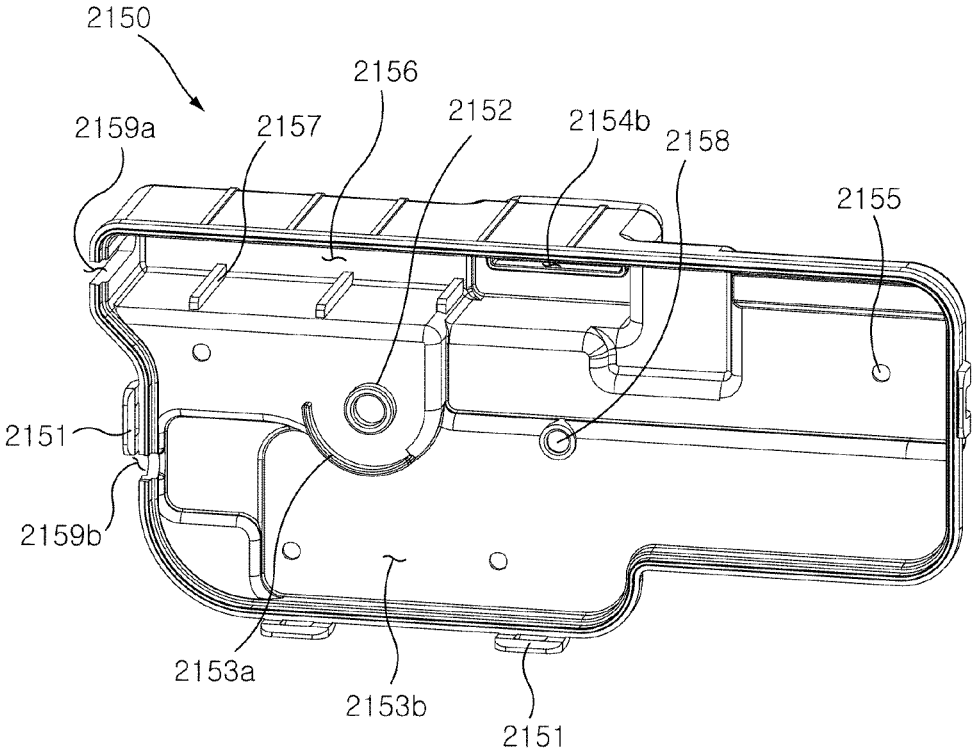
[Fig. 8]
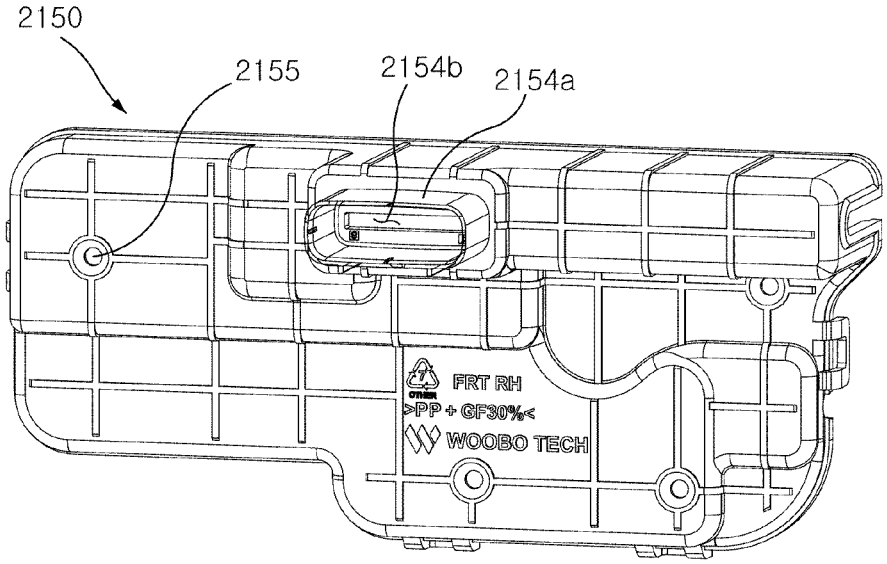

[Fig. 9]
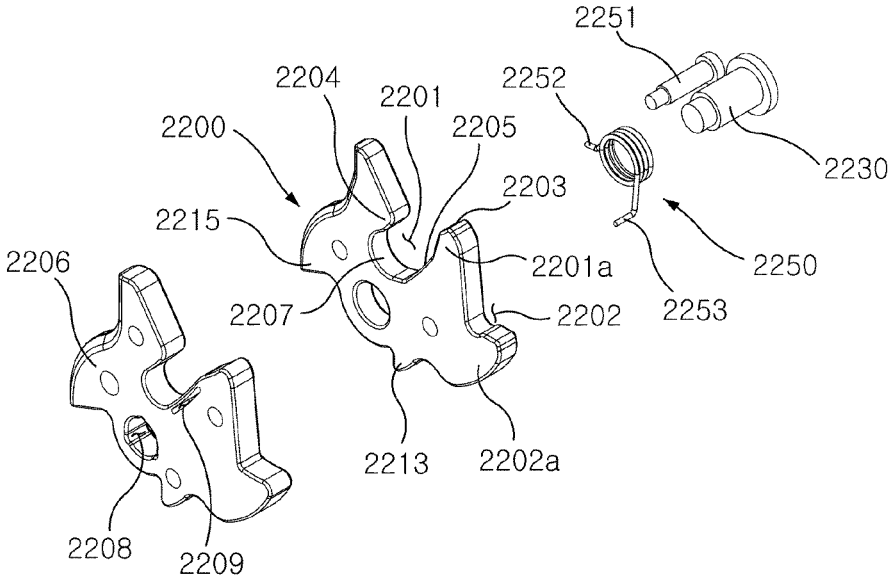
[Fig. 10]
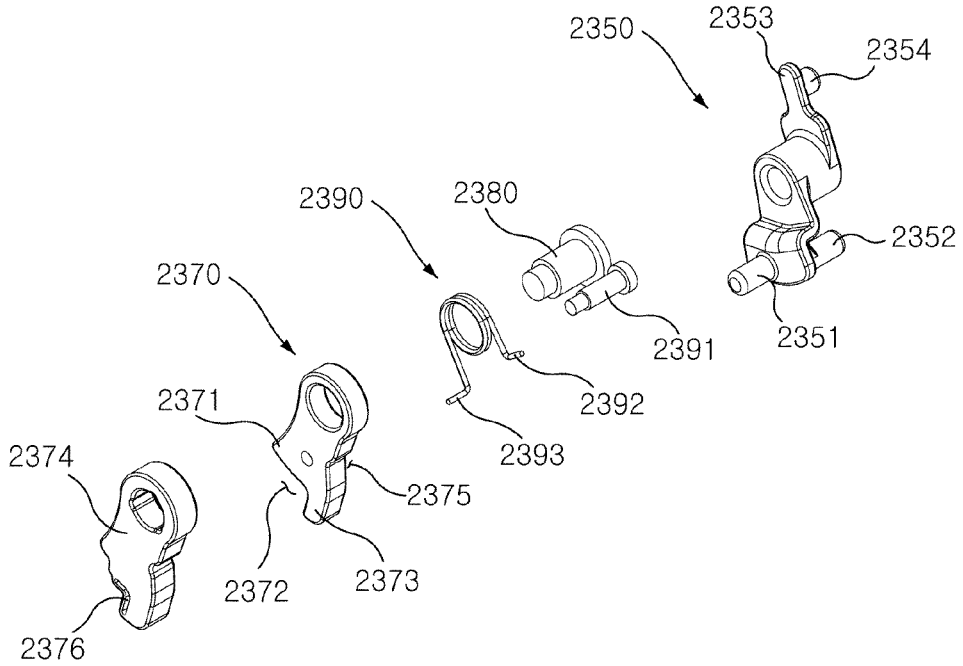

[Fig. 11]
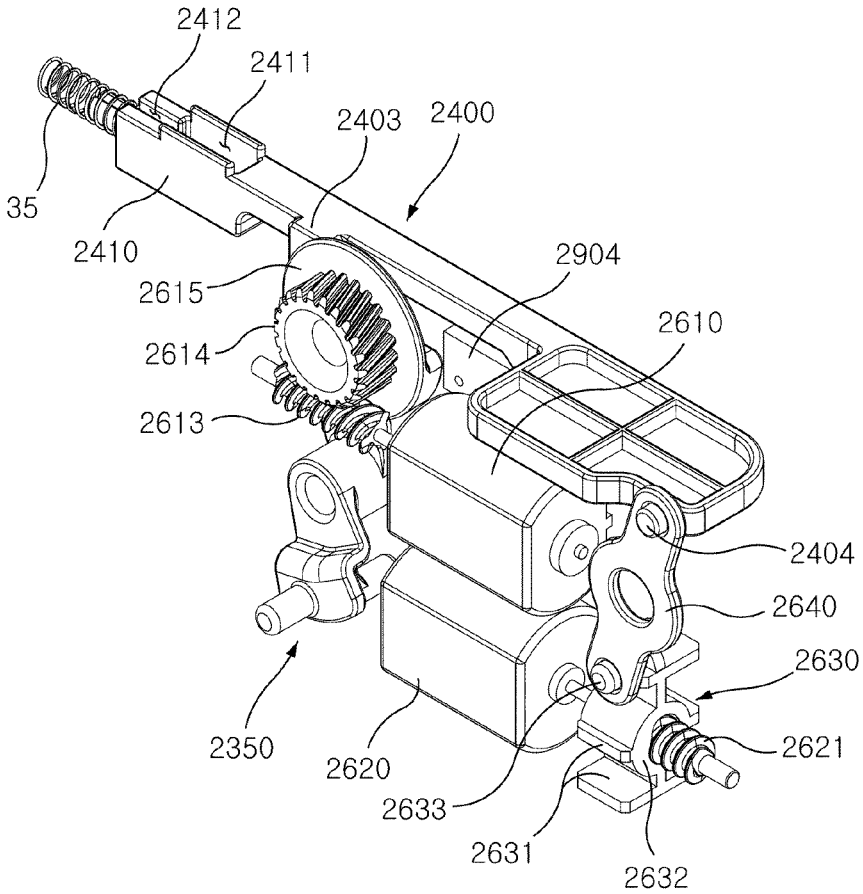
[Fig. 12]
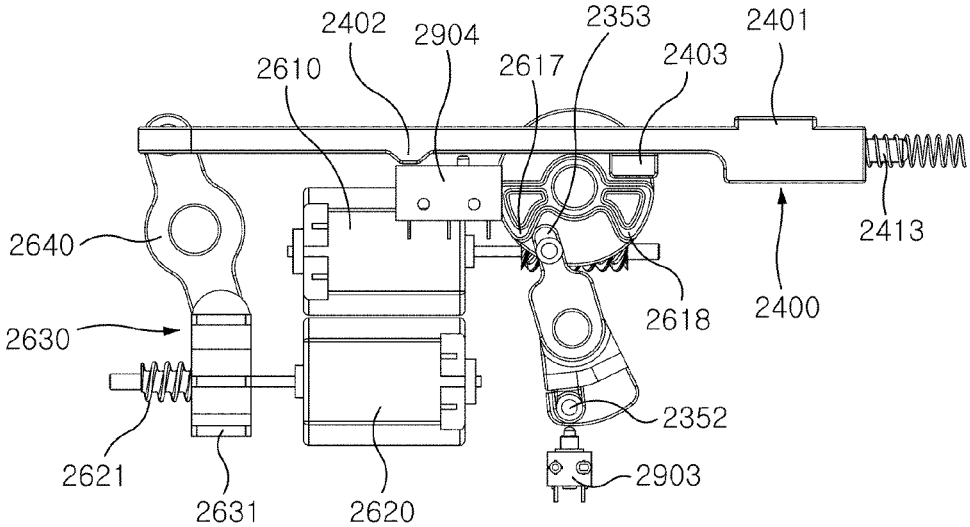

[Fig. 13]
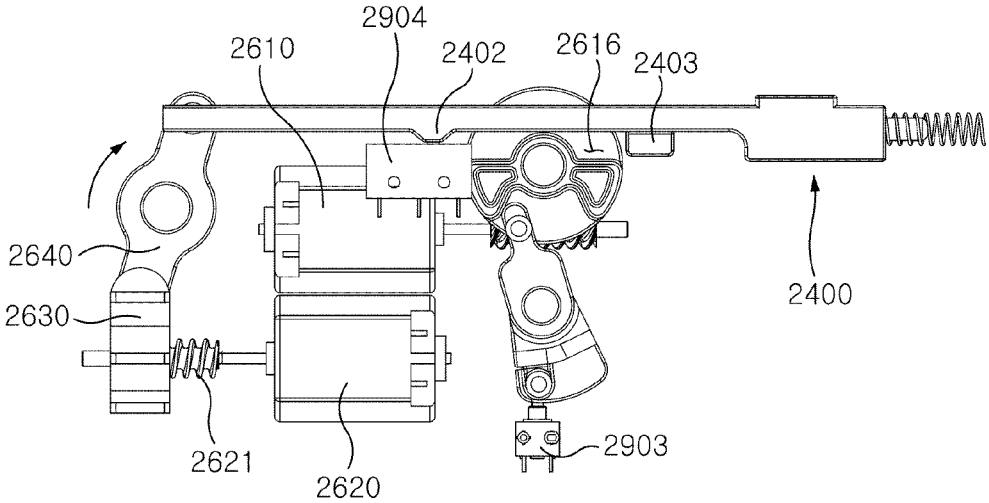
[Fig. 14]
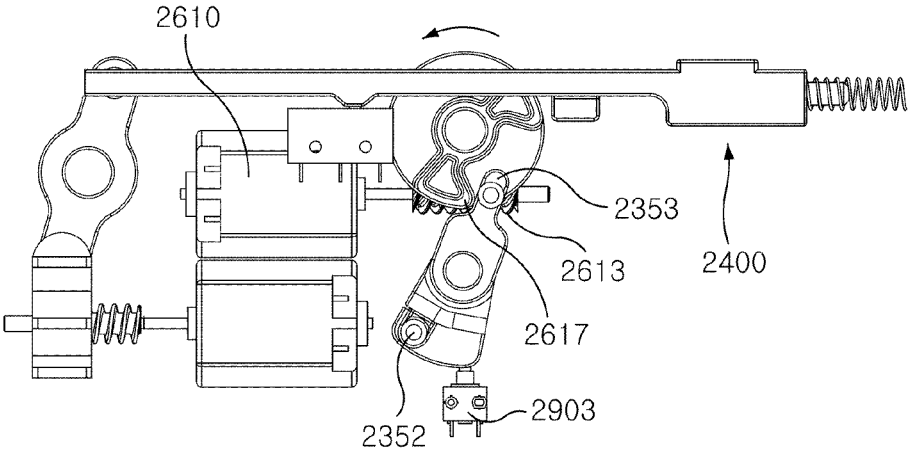

[Fig. 15]
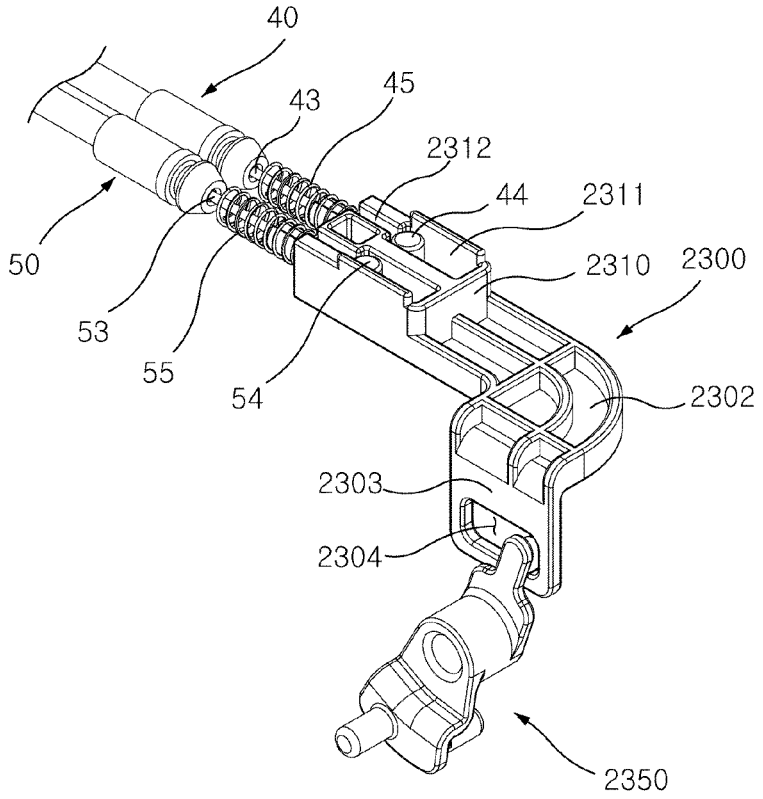
[Fig. 16]
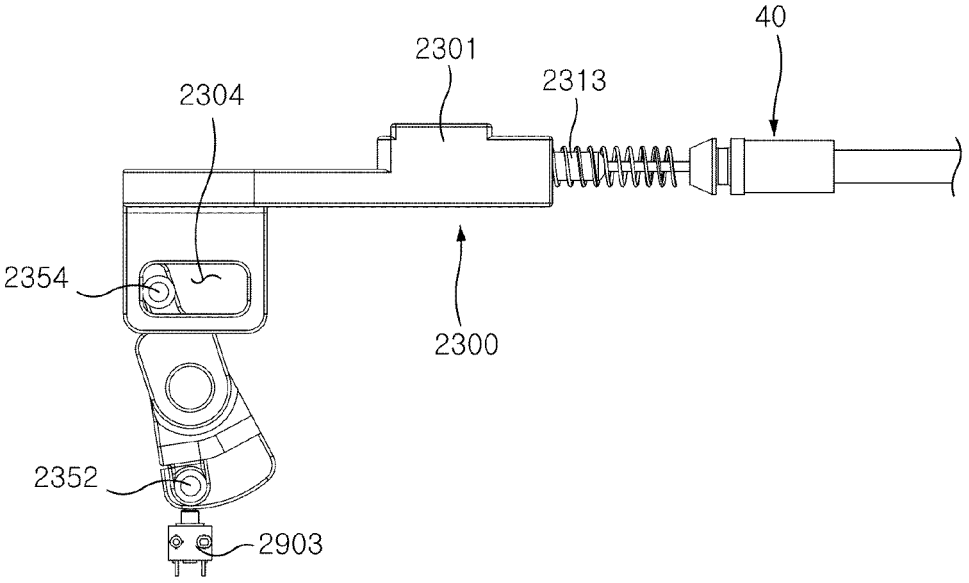

[Fig. 17]
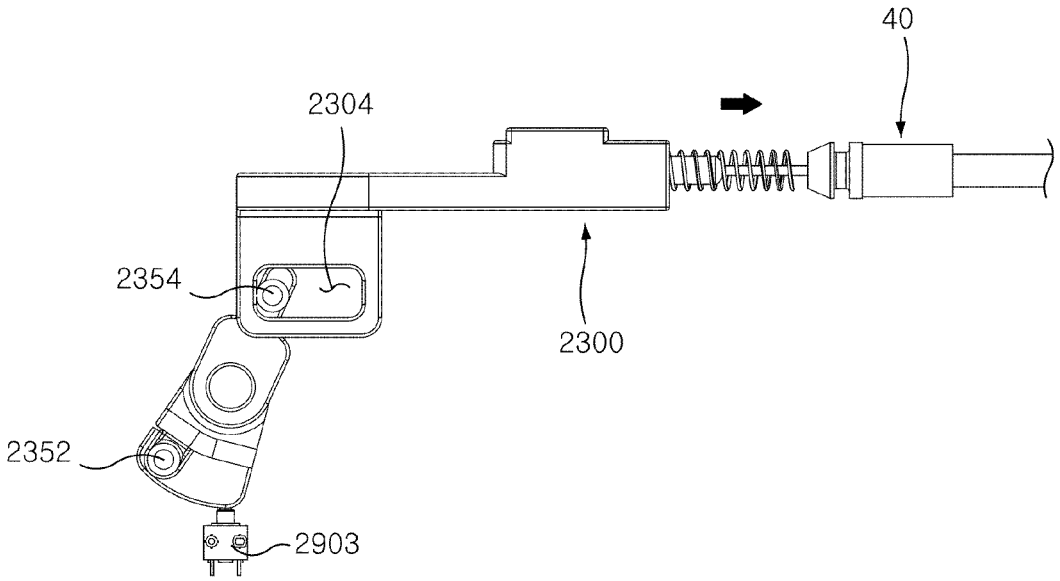
[Fig. 18]
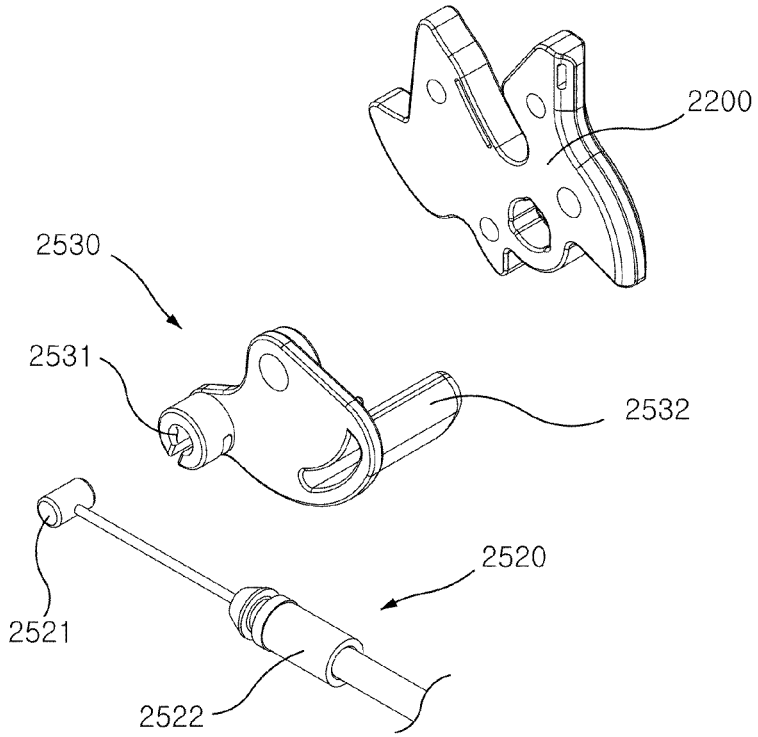

[Fig. 19]
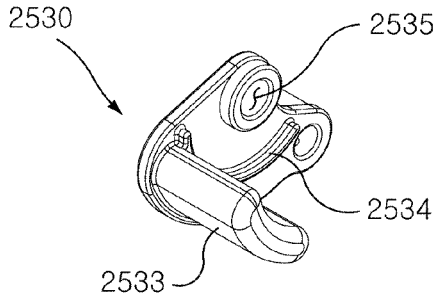
[Fig. 20]
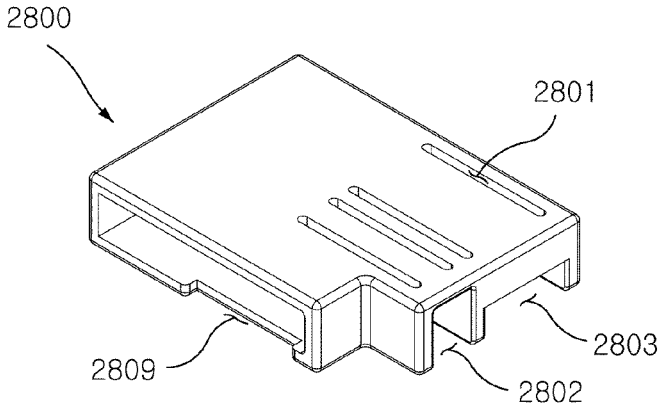
[Fig. 21]
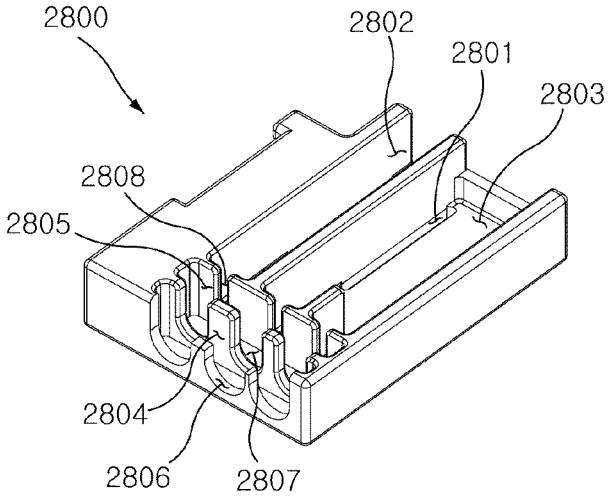

[Fig. 22]
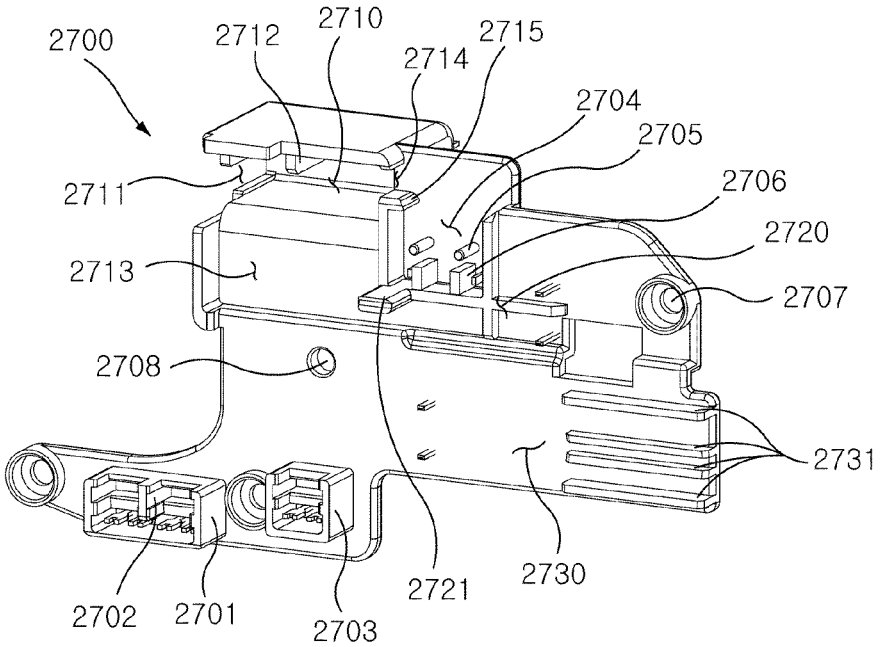
[Fig. 23]
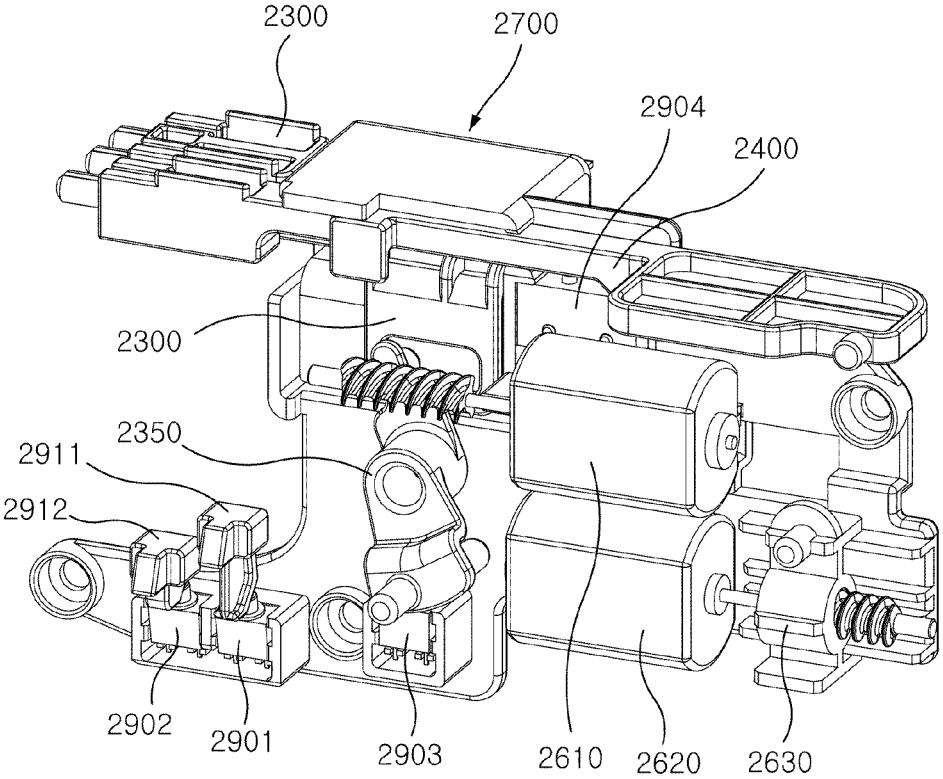

[Fig. 24]
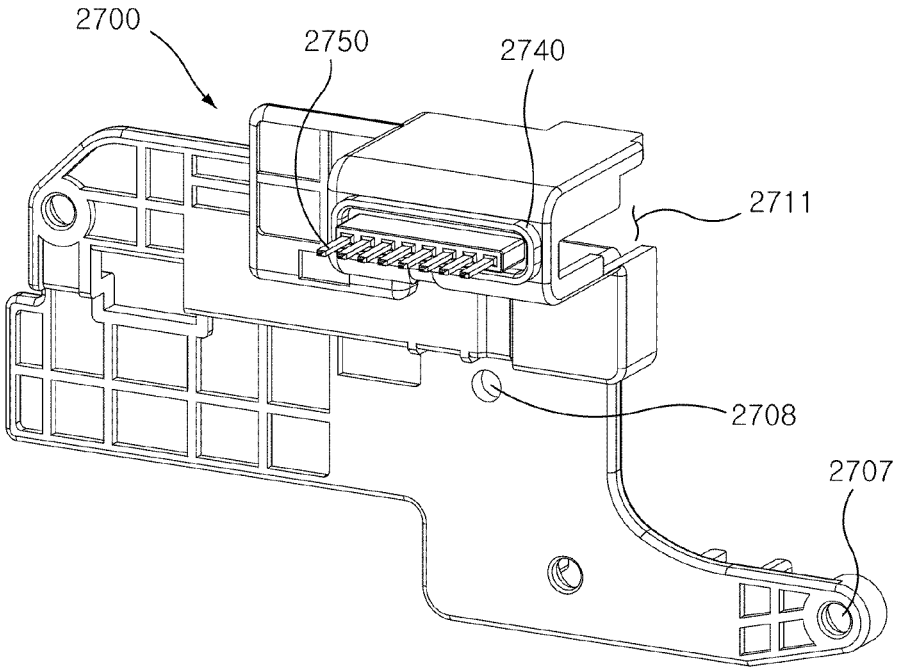
[Fig. 25]
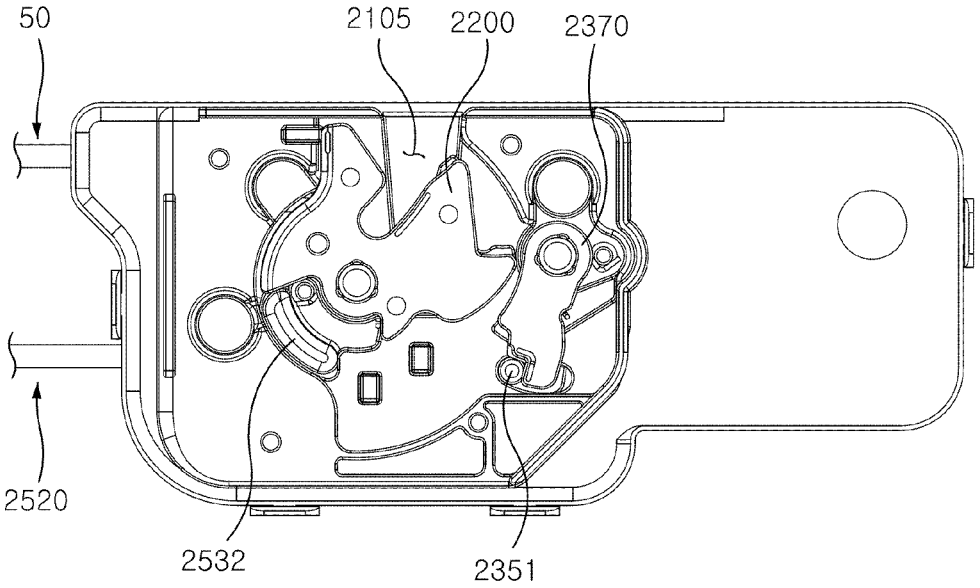

[Fig. 26]
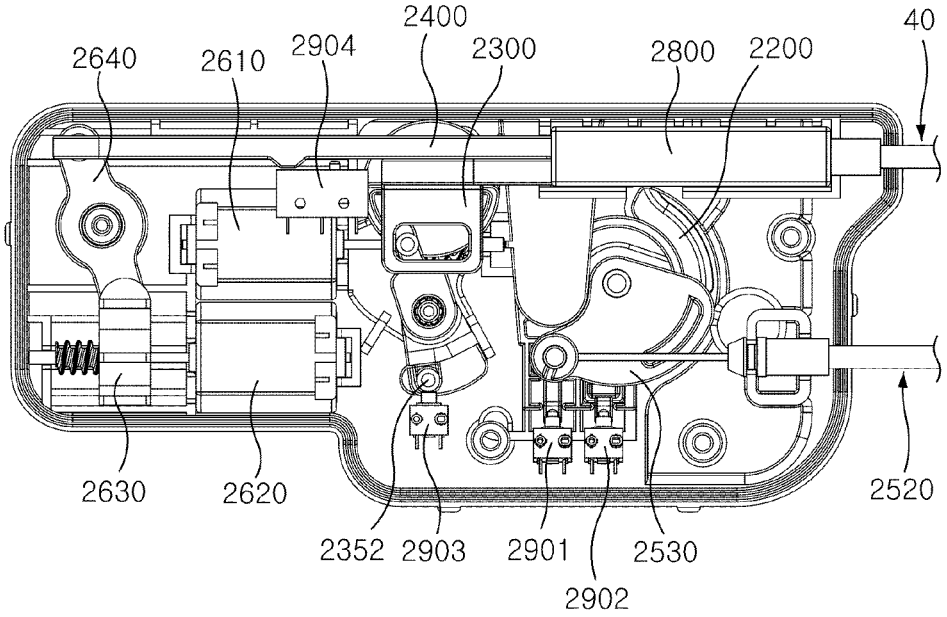

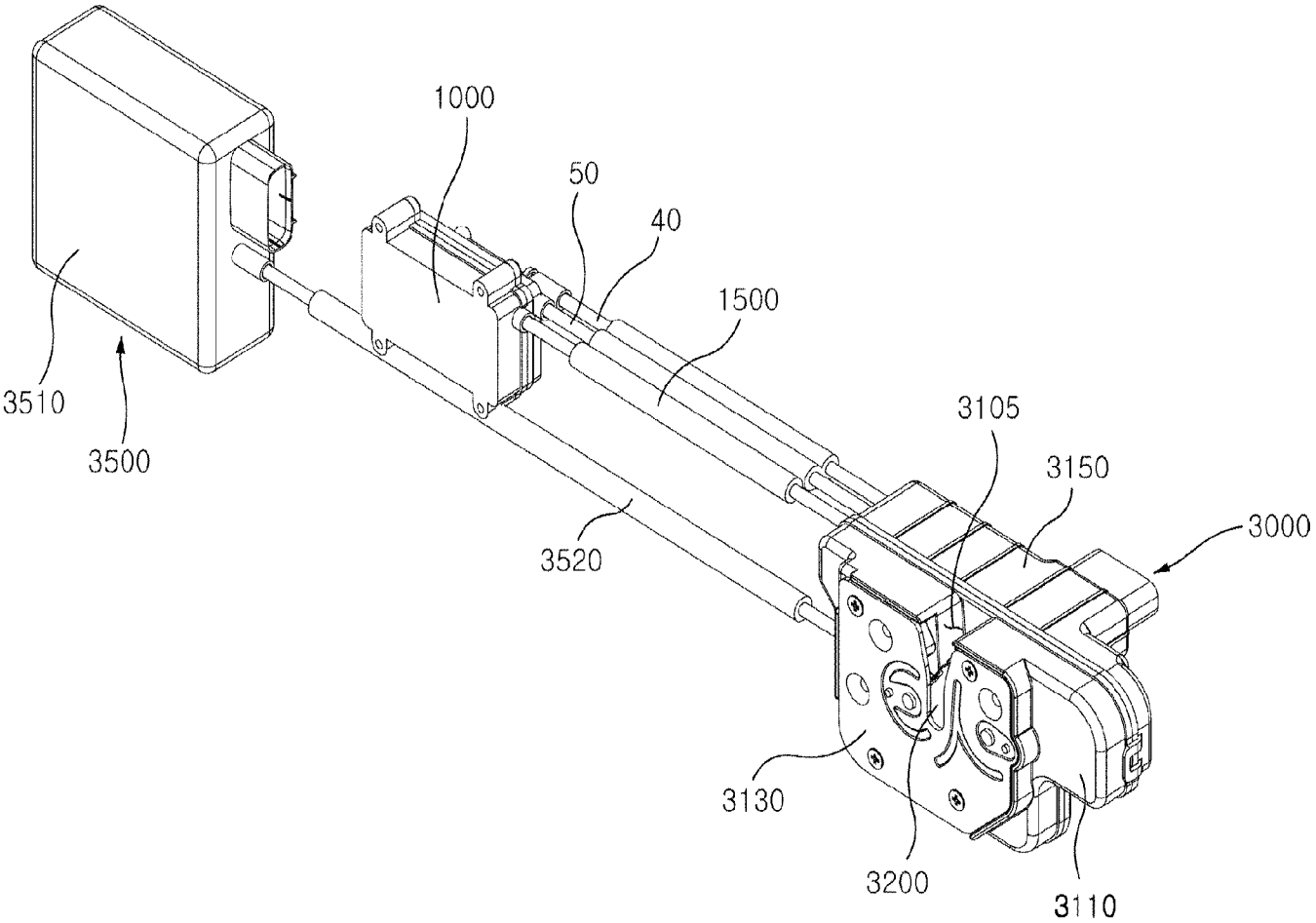
[Fig. 27]

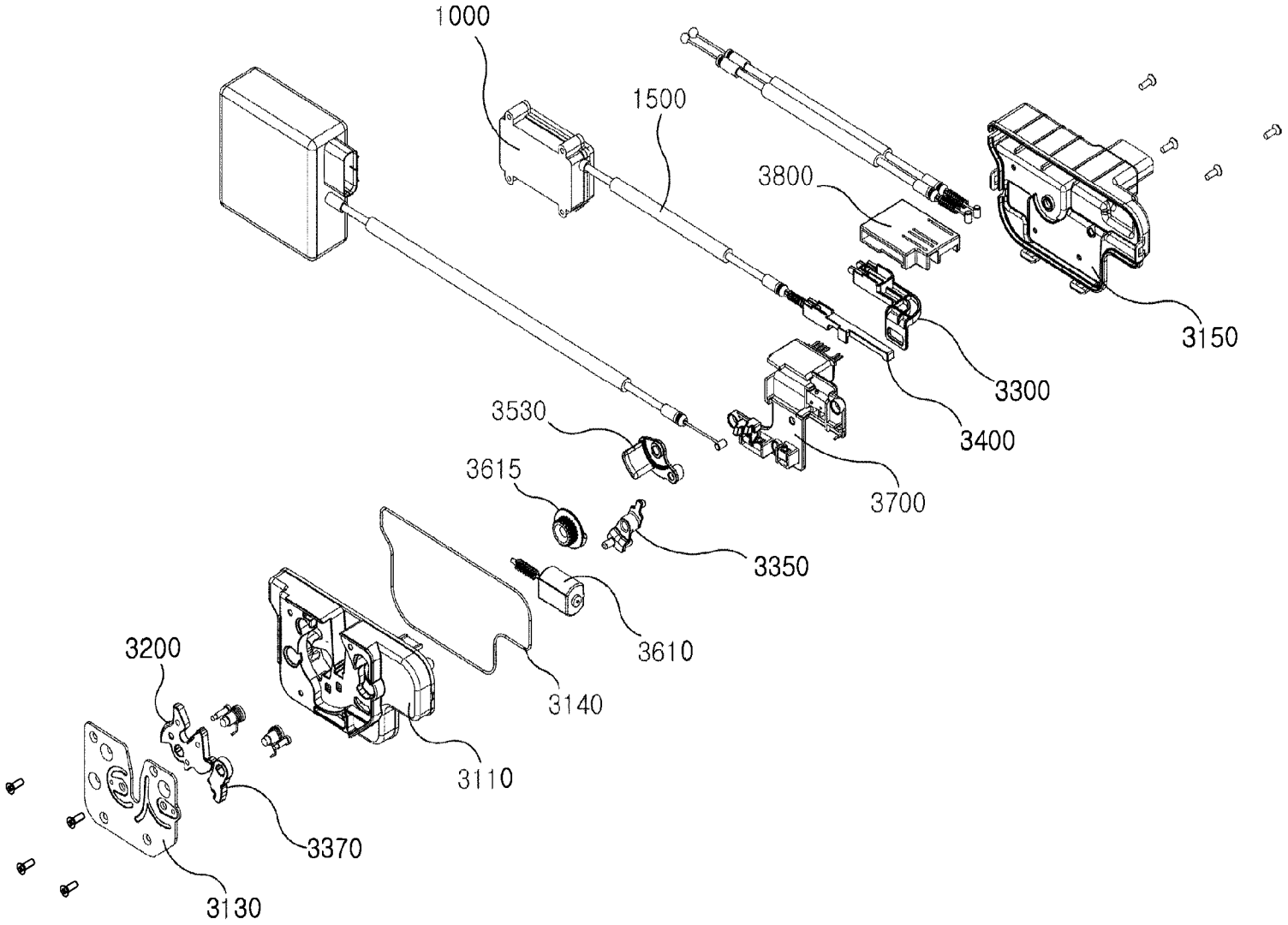
[Fig. 28]

[Fig. 29]
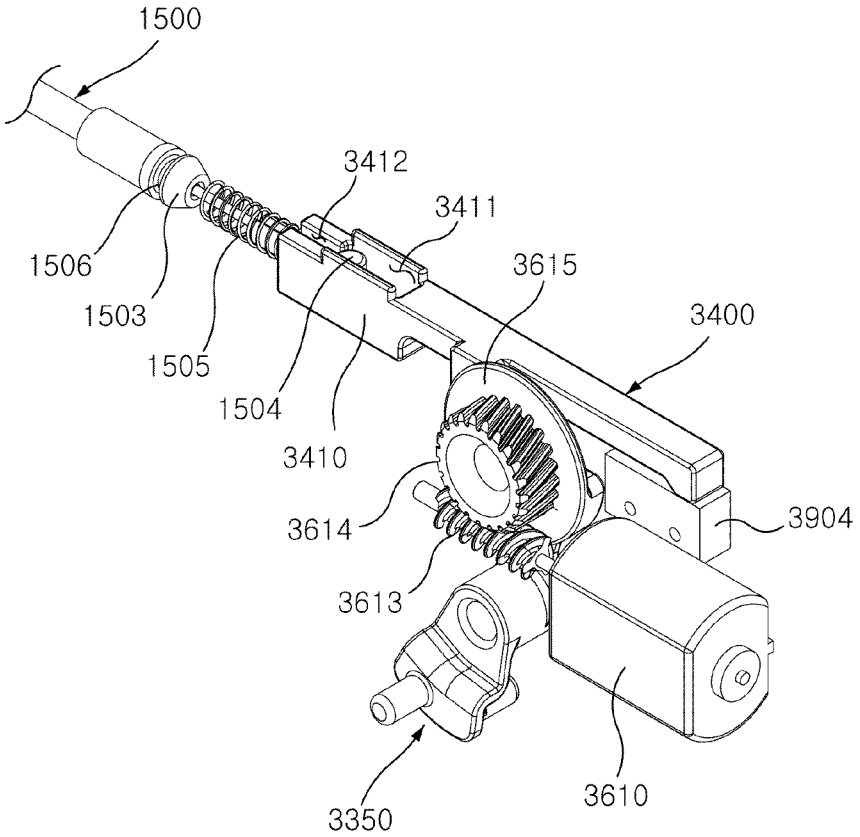
[Fig. 30]
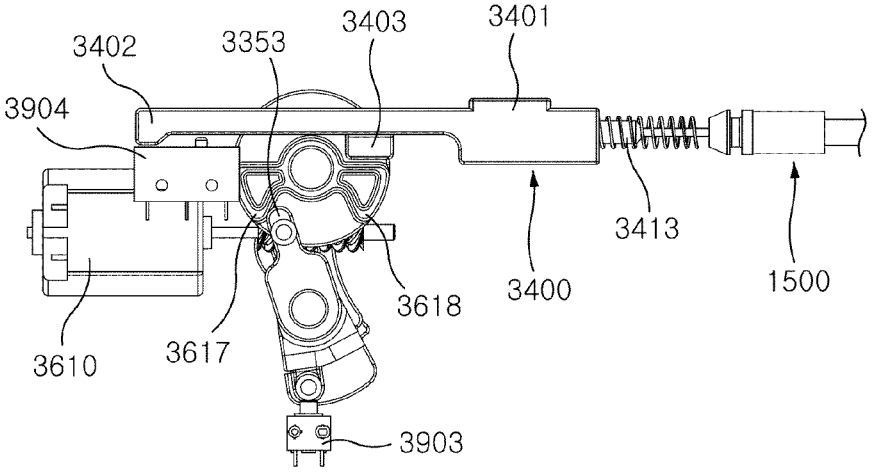

[Fig. 31]
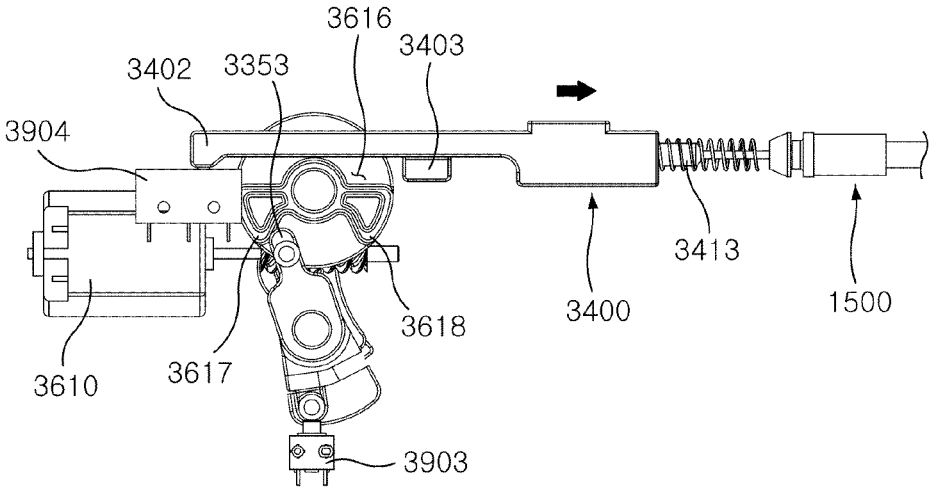
[Fig. 32]
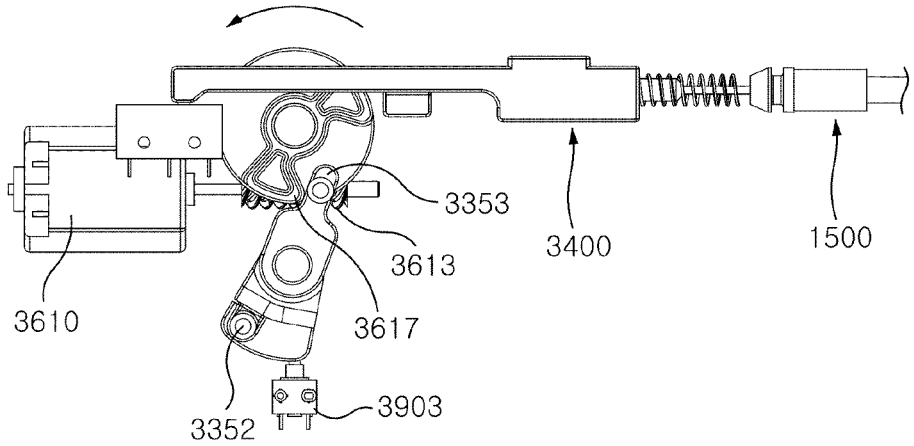

[Fig. 33]
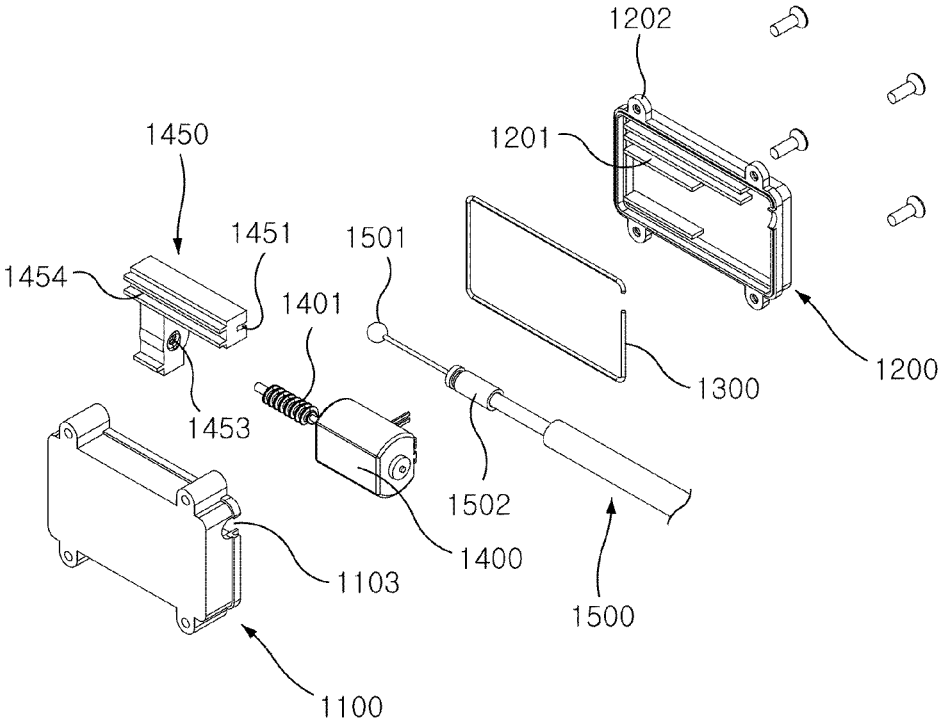
[Fig. 34]
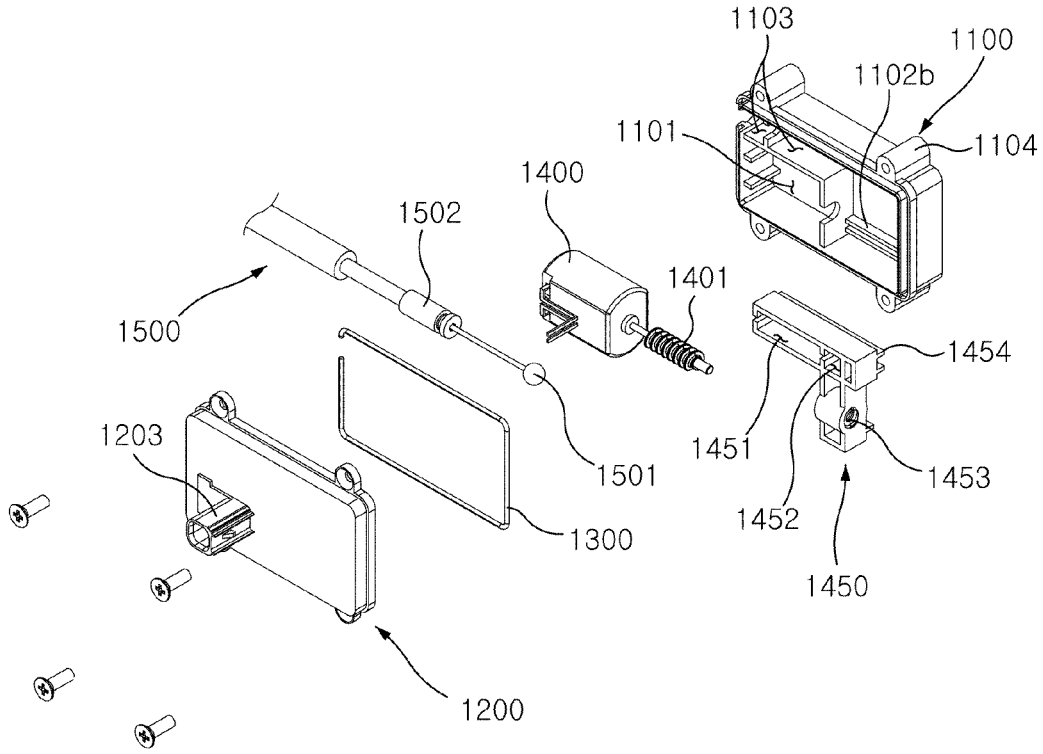

[Fig. 35]
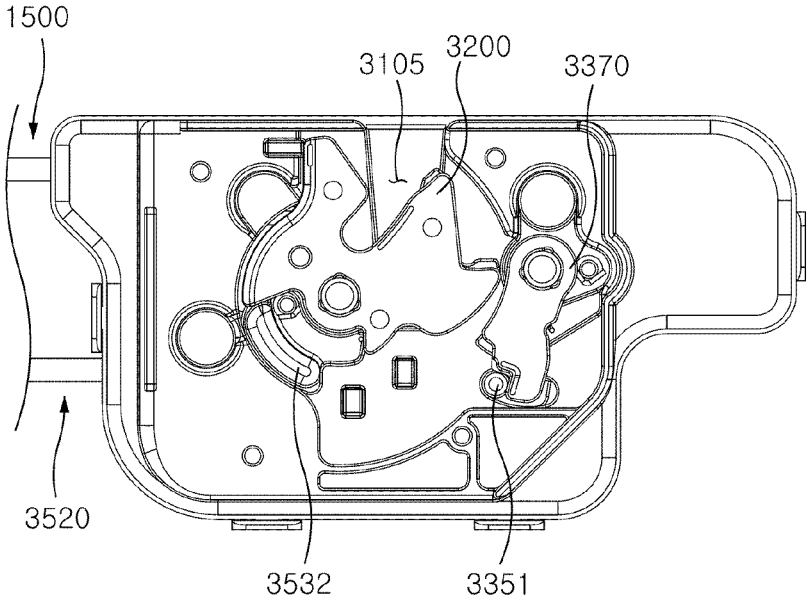
[Fig. 36]
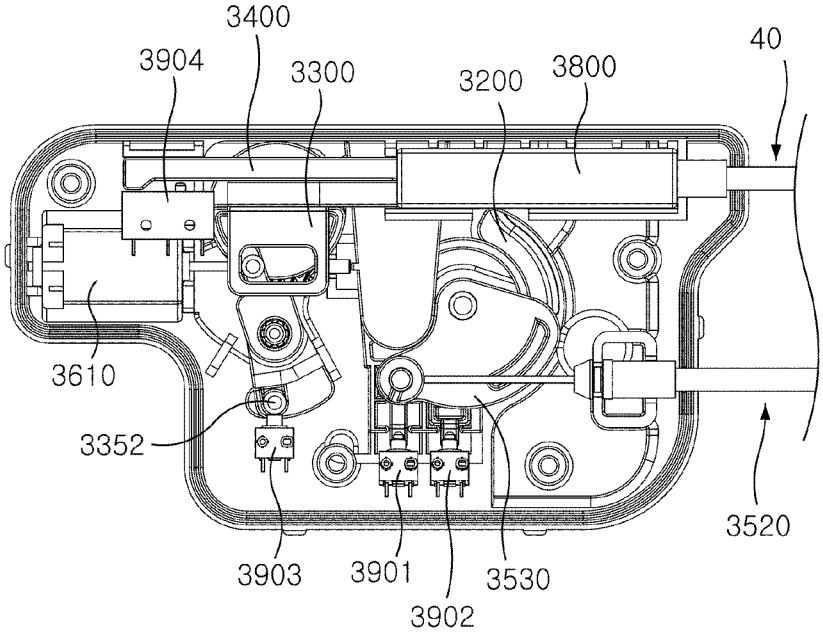

[Fig. 37]
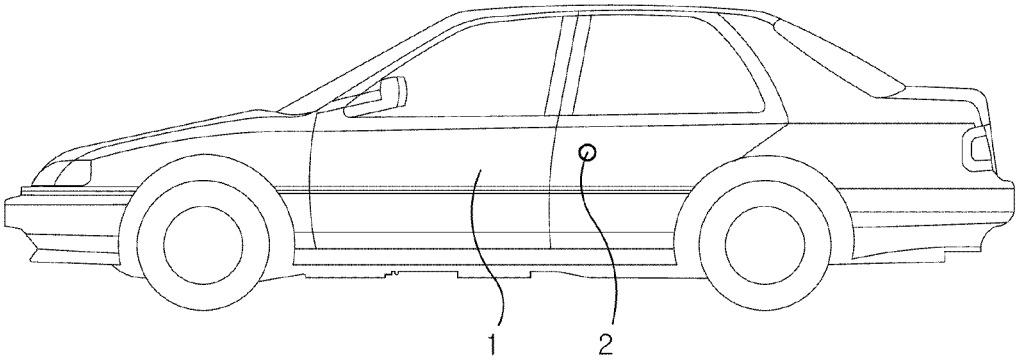

VEHICLE DOOR LATCH WITH SAFETY DEVICE

TECHNICAL FIELD

The present invention relates to a vehicle door latch, and more particularly, to a vehicle door latch with a safety device which mechanically or electrically prevents an electrical malfunction of the vehicle door latch.

BACKGROUND ART

In the interior of a vehicle door, a door latch for performing door locking and unlocking operations and door opening and closing operations is provided.

In the case of a mechanical type vehicle door latch, the vehicle door latch is provided at the exterior of a vehicle door, and operations of locking and unlocking the vehicle door latch may be performed when a vehicle key is inserted into a key cylinder, which is mechanically connected to the vehicle door latch, and the key is rotated.

A user is able to open the vehicle door when the user operates an outside handle or an inside handle, which is provided at the vehicle door, while the door latch is unlocked.

Unlike the mechanical type vehicle door latch, in the case of an electronic type vehicle door latch, operations of locking and unlocking the door latch may be performed by pressing a button of a remote controller (a key fob) or using a smart key, even without using a mechanical device such as a key cylinder.

A conventional electronic type vehicle door latch has been disclosed in Korean Unexamined Patent Application Publication No. 10-2018-0020861. The latch system for a door of a vehicle which has been disclosed in Korean Unexamined Patent Application Publication No. 10-2018-0020861 has a disadvantage in that, when the latch system electrically malfunctions, there is no device capable of preventing the malfunction.

RELATED ART DOCUMENTS

Patent Document (Patent Document 1) Korean Unexamined Patent Application Publication No. 10-2018-0020861

DISCLOSURE OF INVENTION

Technical Problem

The present invention has been devised to address the above-mentioned problem and is directed to providing a safety device capable of mechanically or electrically preventing an electrical malfunction of an electronic latch and providing a vehicle door latch in which the safety device is embedded in an electronic latch or installed at the exterior of the electronic latch.

Solution to Problem

To achieve the above-mentioned objective, a vehicle door latch with a safety device according to the present invention includes: an electronic latch configured to open a vehicle door or maintain a closed state of the vehicle door; a safety plate whose one side is connected to the electronic latch and which is configured to mechanically or electrically inhibit operation of the electronic latch; and a safety actuator connected to another side of the safety plate, wherein, when the safety plate moves due to operation of the safety actuator, power is applied to the electronic latch, and the electronic latch is mechanically operated.

The safety actuator may be embedded in the electronic latch.

The electronic latch may further include a cable whose one side is connected to the electronic latch and whose other side is connected to a retractable handle.

The safety actuator may be installed at the exterior of the electronic latch, and the safety plate may further include a safety cable whose one side is connected to the safety plate and whose other side is connected to the safety actuator.

The other side of the safety cable may be connected to the retractable handle after the safety actuator is removed from the safety cable.

At an outer side of the vehicle door, a handle may not be installed and a pressing switch or a touch input portion may be formed.

Advantageous Effects of Invention

According to a vehicle door latch with a safety device according to the present invention described above, there are the following advantageous effects.

By using a safety actuator and a safety plate, particularly when opening a door, it is possible to mechanically or electrically prevent an electrical malfunction of an electronic latch.

By embedding the safety actuator in the electronic latch, it is possible to make the device compact.

By installing the safety actuator at the exterior of the electronic latch, it is possible to reduce the volume of the electronic latch and freely adjust the position of the safety actuator.

Due to the electronic latch and the safety actuator, it is possible to mechanically or electronically prevent an electrical malfunction of the electronic latch, even without a retractable handle of a vehicle door that is mechanically connected to the electronic latch.

It is possible to conveniently open the vehicle door using a pressing switch or a touch input portion, even without the handle of the vehicle door.

BRIEF DESCRIPTION OF DRAWINGS

FIG. 1 is a front perspective view of a door latch with a safety device according to a first exemplary embodiment of the present invention.

FIG. 2 is a front exploded perspective view of the door latch with the safety device according to the first exemplary embodiment of the present invention.

FIG. 3 is a front perspective view of a first housing of the door latch with the safety device according to the first exemplary embodiment of the present invention.

FIG. 4 is a rear perspective view of the first housing of the door latch with the safety device according to the first exemplary embodiment of the present invention.

FIG. 5 is a front perspective view of a second housing of the door latch with the safety device according to the first exemplary embodiment of the present invention.

FIG. 6 is a rear perspective view of the second housing of the door latch with the safety device according to the first exemplary embodiment of the present invention.

FIG. 7 is a front perspective view of a third housing of the door latch with the safety device according to the first exemplary embodiment of the present invention.

FIG. 8 is a rear perspective view of the third housing of the door latch with the safety device according to the first exemplary embodiment of the present invention.

FIG. 9 is a front exploded perspective view of the door latch with the safety device according to the first exemplary embodiment of the present invention.

FIG. 10 is a front exploded perspective view of a pivoting member and an open lever of the door latch with the safety device according to the first exemplary embodiment of the present invention.

FIG. 11 is a front perspective view of a driving portion and a safety plate of the door latch with the safety device according to the first exemplary embodiment of the present invention.

FIG. 12 is a rear view of the driving portion and the safety plate of the door latch with the safety device according to the first exemplary embodiment of the present invention (initial state).

FIG. 13 is a rear view of the driving portion and the safety plate of the door latch with the safety device according to the first exemplary embodiment of the present invention (state in which safety motor is driven).

FIG. 14 is a rear view of the driving portion and the safety plate of the door latch with the safety device according to the first exemplary embodiment of the present invention (state in which motor is driven).

FIG. 15 is a front perspective view of an open plate and the open lever of the door latch with the safety device according to the first exemplary embodiment of the present invention.

FIG. 16 is a rear view of the open plate and the open lever of the door latch with the safety device according to the first exemplary embodiment of the present invention (initial state).

FIG. 17 is a rear view of the open plate and the open lever of the door latch with the safety device according to the first exemplary embodiment of the present invention (state in which open lever is pulled).

FIG. 18 is a rear perspective view of a lever of the door latch with the safety device according to the first exemplary embodiment of the present invention and elements around the lever.

FIG. 19 is a front perspective view of the lever of the door latch with the safety device according to the first exemplary embodiment of the present invention.

FIG. 20 is a front perspective view of a connecting portion cover of the door latch with the safety device according to the first exemplary embodiment of the present invention.

FIG. 21 is a rear perspective view of the connecting portion cover of the door latch with the safety device according to the first exemplary embodiment of the present invention.

FIG. 22 is a front perspective view of an insert plate of the door latch with the safety device according to the first exemplary embodiment of the present invention.

FIG. 23 is a front perspective view illustrating a state in which elements are installed at the insert plate of the door latch with the safety device according to the first exemplary embodiment of the present invention.

FIG. 24 is a rear perspective view of the insert plate of the door latch with the safety device according to the first exemplary embodiment of the present invention.

FIG. 25 is a front view of the door latch with the safety device according to the first exemplary embodiment of the present invention (excluding the second housing).

FIG. 26 is a rear view of the door latch with the safety device according to the first exemplary embodiment of the present invention (excluding the third housing and the insert plate).

FIG. 27 is a front perspective view of a door latch with a safety device according to a second exemplary embodiment of the present invention.

FIG. 28 is a rear exploded perspective view of the door latch with the safety device according to the second exemplary embodiment of the present invention.

FIG. 29 is a front perspective view of a driving portion and an open plate of the door latch with the safety device according to the second exemplary embodiment of the present invention.

FIG. 30 is a rear view of the driving portion and the open plate of the door latch with the safety device according to the second exemplary embodiment of the present invention (initial state).

FIG. 31 is a rear view of the driving portion and the open plate of the door latch with the safety device according to the second exemplary embodiment of the present invention (state in which open plate is pulled).

FIG. 32 is a rear view of the driving portion and the open plate of the door latch with the safety device according to the second exemplary embodiment of the present invention (state in which motor is driven).

FIG. 33 is a front exploded perspective view of a safety actuator of the door latch with the safety device according to the second exemplary embodiment of the present invention.

FIG. 34 is a rear exploded perspective view of the safety actuator of the door latch with the safety device according to the second exemplary embodiment of the present invention.

FIG. 35 is a front view of the door latch with the safety device according to the second exemplary embodiment of the present invention (excluding the second housing).

FIG. 36 is a rear view of the door latch with the safety device according to the second exemplary embodiment of the present invention (excluding the third housing and the insert plate).

FIG. 37 is a side view of an automobile using a door latch with a safety device according to an exemplary embodiment of the present invention.

MODE FOR THE INVENTION

Hereinafter, exemplary embodiments of the present invention will be described in detail with reference to the accompanying drawings.

For configurations identical to those of the related art among the configurations of the present invention which will be described below, reference should be made to the above-described related art, and detailed description of the identical configurations will be omitted.

When it is mentioned that a certain portion is "above" another portion, this includes a case in which another portion is interposed therebetween as well as a case in which the portion is directly above the other portion. Conversely, when it is mentioned that a certain portion is "directly above" another portion, this does not include the case in which another portion is interposed therebetween.

Technical terms used herein are merely for mentioning specific embodiments and are not intended to limit the present invention. Singular expressions used herein include plural expressions unless the context clearly indicates otherwise.

The term "include" used herein concretizes specific features, regions, integers, steps, operations, elements, and/or components and do not preclude the existence of or the possibility of adding other specific features, regions, integers, steps, operations, elements, components, and/or groups.

Terms such as "below" and "above" which indicate a relative space may be used to facilitate description of the relationship between one portion and another portion illustrated in the drawings. Such terms are intended to encompass different meanings or operations of the apparatus in use, as well as intended meanings in the drawings. For example, when the apparatus in the drawings is flipped upside down, certain portions which are described as being "below" other portions should be described as being "above" the other portions. Therefore, an illustrative term such as "below" encompasses both upward and downward directions. The apparatus may be rotated at an angle of 90° or another angle, and terms which indicate a relative space should be interpreted according to the rotation.

Hereinafter, exemplary embodiments of an integrated apparatus for electronic opening and closing of a vehicle door will be described.

First Embodiment

In a first embodiment, the front or the rear refers to a front-rear direction (longitudinal direction) of the vehicle, an up-down direction refers to a left-right direction (width direction) of the vehicle, and a left-right direction refers to an up-down direction of the vehicle.

A vehicle door latch with a safety device according to the first embodiment includes an electronic latch configured to open a vehicle door or maintain a closed state of the vehicle door, a safety plate 2400 whose one side is connected to the electronic latch and which is configured to mechanically or electrically inhibit operation of the electronic latch, and a safety actuator connected to another side of the safety plate 2400.

In the first embodiment, a vehicle in which a handle is not installed at a vehicle door 1 and the vehicle door 1 is opened by a touch sensor 2, a switch, or the like as illustrated in FIG. 37 will be described as an example.

The vehicle door 1 is slightly opened by the electronic latch when a user presses the touch sensor 2 of the vehicle door 1, and the user may completely open the vehicle door 1 by pulling side surface of the vehicle door 1.

Since a handle is not installed at the vehicle door 1, the handle and components relating to the handle are omitted such that the cost corresponding thereto is saved, and a space inside a vehicle body becomes larger.

Due to the touch sensor 2, the user may open the vehicle door 1 with less effort.

The vehicle may include a door lever connecting portion 40 and a door key connecting portion 50 capable of unlocking the electronic latch in case of emergency.

The door lever connecting portion 40 has one side connected to a manual lever formed in the interior of the vehicle door 1 and has another side connected to the electronic latch.

The door key connecting portion 50 has one side connected to a key cylinder formed at the exterior of the vehicle door 1 and has another side connected to the electronic latch.

As illustrated in FIGS. 1 and 2, the electronic latch includes a latch portion 2000 and a cinching module 2500.

The latch portion 2000 includes a housing, a latch 2200 pivotally installed at the housing, a pivoting member 2370 configured to lock or unlock the latch 2200, an open lever 2350 configured to rotate the pivoting member 2370, an open plate 2300 configured to rotate the open lever 2350, and a driving portion.

Hereinafter, each configuration will be described in detail with reference to FIG. 2.

<Housing>

Hereinafter, the housing will be described.

As illustrated in FIG. 2, the housing includes a first housing 2110, a second housing 2130 disposed at the front of the first housing 2110, and a third housing 2150 disposed at the rear of the first housing 2110.

The first housing 2110 is illustrated in detail in FIGS. 3 and 4.

A sealing member 2140 is disposed between a circumference of a rear surface of the first housing 2110 and a circumference (edge) of a front surface of the third housing 2150 so that the driving portion is prevented from being damaged due to water.

As illustrated in FIG. 1, a striker insertion groove 2105, into which a striker (not illustrated) connected to a vehicle body is inserted, is formed at the upper portion and front of the housing. The striker insertion groove 2105 is formed to be open upward and forward and have a blocked rear portion.

Therefore, the striker insertion groove 2105 formed in the first housing 2110 is formed in the shape of a groove, and the striker insertion groove 2105 formed in the second housing 2130 is formed in the shape of a hole penetrating in the front-rear direction.

As illustrated in FIG. 3, the first housing 2110 is formed in a plate shape.

In a front surface of the first housing 2110, a latch installation groove 2111 in which the latch 2200, which will be described below, is installed and a pivoting member installation groove 2116 in which the pivoting member 2370 is installed are formed.

The first housing 2110 may be formed of a plastic material and formed by injection molding. Thus, the apparatus may be easily manufactured.

Since the latch installation groove 2111 is formed to be open forward and have a blocked rear portion, assembly of parts is facilitated. The front of the latch installation groove 2111 is covered by the second housing 2130 during assembly.

An upper portion of the latch installation groove 2111 comes into communication with the striker insertion groove 2105.

Further, a spring insertion groove 2113 is formed in the front of the first housing 2110.

The spring insertion groove 2113 is disposed at the rear of the latch installation groove 2111 and comes into communication with the latch installation groove 2111. The spring insertion groove 2113 is formed in a fan shape, and a first restoring spring 2250, which will be described below, is inserted into the spring insertion groove 2113 so that a second bent portion 2253 of the first restoring spring 2250 may rotate together with the latch 2200.

A sensor transfer member insertion portion 2129 into which a first sensor transfer member 2911 and a second sensor transfer member 2912, which will be described below, are inserted is formed at the first housing 2110 so as to come into communication with the latch installation groove 2111. The sensor transfer member insertion portion 2129 is disposed at a lower portion of the striker insertion groove 2105. The sensor transfer member insertion portion 2129 is formed to be open rearward and includes a groove penetrating in the front-rear direction.

In a left side of the first housing 2110, a catching portion guide groove 2115 is formed to be penetrated in the front-rear direction so as to come into communication with the spring insertion groove 2113 and the latch installation groove 2111.

The catching portion guide groove 2115 is formed in an arc shape around circumferences of the spring insertion groove 2113 and the latch installation groove 2111.

The pivoting member installation groove 2116 is disposed at a right side of the latch installation groove 2111. Since the pivoting member installation groove 2116 is formed to be open forward and have a blocked rear portion, assembly of parts is facilitated. The front of the pivoting member installation groove 2116 is covered by the second housing 2130 during assembly.

A left side of the pivoting member installation groove 2116 comes into communication with a right side of the latch installation groove 2111.

Further, a spring insertion groove 2117 is formed at the front of the first housing 2110.

The spring insertion groove 2117 is disposed at the rear of the pivoting member installation groove 2116 and comes into communication with the pivoting member installation groove 2116. The spring insertion groove 2117 is formed in the shape of an egg, and a pivoting member spring 2390, which will be described below, is inserted into the spring insertion groove 2117 so that a second bent portion 2393 of the pivoting member spring 2390 may rotate together with the pivoting member 2370.

A pivoting member catching portion through-hole 2118 is formed in the right side of the first housing 2110. The pivoting member catching portion through-hole 2118 is formed in an arc shape in the left-right direction and formed to be penetrated in the front-rear direction.

The pivoting member catching portion through-hole 2118 is disposed at a lower portion of the spring insertion groove 2117 and comes into communication with the pivoting member installation groove 2116.

A bumper member insertion groove 2123 into which a bumper member 2360 is inserted is formed in middle and upper portions of the first housing 2110 so as to come into communication with the striker insertion groove 2105 or the latch installation groove 2111.

The bumper member insertion groove 2123 disposed in the middle portion is open forward and upward, and an upper portion of the bumper member insertion groove 2123 comes into communication with the striker insertion groove 2105.

The bumper member insertion groove 2123 disposed in the upper portion is open forward, and a right side portion of the bumper member insertion groove 2123 comes into communication with the latch installation groove 2111.

The bumper member 2360 disposed at the middle portion may prevent impact or noise due to contact with the first housing 2110 when the striker is inserted into the striker insertion groove 2105.

The bumper member 2360 disposed at the upper portion may prevent impact or noise due to contact with the first housing 2110 when the latch 2200 rotates and reaches an open state.

An edge of the first housing 2110 is formed to protrude to the rear so that a space is also formed at the rear of the first housing 2110.

A motor installation portion 2112 in which a motor 2610, which will be described below, is installed is formed at an upper portion of a right side of the rear surface of the first housing 2110. A groove is formed in a left side and a right side of the motor installation portion 2112 so that a shaft of the motor 2610 may be fitted thereinto.

A first guide portion 2125 is formed at a right side of the rear surface of the first housing 2110 so as to protrude to the rear. The first guide portion 2125 is disposed at an upper portion of the motor installation portion 2112. A lower surface of the first guide portion 2125 abuts an upper surface of the safety plate 2400, which will be described below, and guides sliding of the safety plate 2400 in the left-right direction.

A shaft 2106, a first open lever guide portion 2107, and a second open lever guide portion 2108 are formed at the right side of the rear surface of the first housing 2110 so as to protrude to the rear. The shaft 2106 is disposed at a lower portion of a left side of the motor installation portion 2112. The first open lever guide portion 2107 is disposed at a lower portion of a left side of the shaft 2106, and the second open lever guide portion 2108 is disposed at a lower portion of a right side of the shaft 2106. The open lever 2350 is fitted to the shaft 2106. The first and second open lever guide portions 2107 and 2108 are disposed within a radius of rotation of the open lever 2350 so that the open lever 2350 may rotate within a predetermined range when rotating about the shaft 2106.

A lever shaft 2114 fitted into an insertion hole 2535 of a lever 2530, which will be described below, is formed at a left side of the rear surface of the first housing 2110 so as to protrude to the rear.

A first connecting portion cover installation portion 2126 at which a connecting portion cover 2800, which will be described below, is installed is formed at an upper portion of the left side of the rear surface of the first housing 2110. The first connecting portion cover installation portion 2126 comes into communication with a second connecting portion cover installation portion 2128 which is formed at an upper portion of the center of the rear surface of the first housing 2110.

A plurality of protrusions are formed at upper portions of the first and second connecting portion cover installation portions 2126 and 2128 so that the connecting portion cover 2800 may be easily inserted. A protrusion is formed to protrude to the rear at a left side of the first connecting portion cover installation portion 2126 and a right side of the second connecting portion cover installation portion 2128 so that the connecting portion cover 2800 is prevented from falling off in the left-right direction.

An upper surface of a lower portion of the second connecting portion cover installation portion 2128 abuts lower surfaces of the open plate 2300 and the safety plate 2400 and guides sliding of the open plate 2300 and the safety plate 2400 in the left-right direction.

A cinching connecting portion installation portion 2119 at which a cinching connecting portion 2520, which will be described below, is installed is formed to protrude at the lower portion of the left side of the rear surface of the first housing 2110. A groove into which a fixing portion 2522 of the cinching connecting portion 2520 may be fitted and fixed is formed at the rear of the cinching connecting portion installation portion 2119.

A second guide portion 2127 is formed to protrude at the center of the rear surface of the first housing 2110. The second guide portion 2127 is disposed below the second connecting portion cover installation portion 2128. The second guide portion 2127 is formed to correspond to the shape of the striker insertion groove 2105. The second guide portion 2127 is disposed at a right side of the lever shaft 2114.

A safety motor installation portion 2120 at which a safety motor 2620, which will be described below, is installed is formed at a lower portion of the motor installation portion 2112. A groove is formed in a left side, a right side, and the center of the safety motor installation portion 2120 so that a shaft of the safety motor 2620 may be fitted thereinto.

A third guide portion 2103 configured to guide sliding of a safety valve 2630, which is installed in the safety motor 2620, in the left-right direction is formed at a right side of the safety motor installation portion 2120. The third guide portion 2103 is formed to protrude longitudinally in the left-right direction. The third guide portion 2103 is formed in plurality in the up-down direction.

A safety lever shaft 2109 is formed in the shape of a boss at a right side portion of the motor installation portion 2112 so as to protrude to the rear. The front of a hole into which a bolt is fastened that is formed in the safety lever shaft 2109 is blocked. A rear end of the safety lever shaft 2109 is formed to protrude further to the rear than the edge of the first housing 2110. Screw threads are formed at an inner circumferential surface of the safety lever shaft 2109 during bolt assembly. A safety lever 2640 is inserted into an outer circumferential surface of the safety lever shaft 2109.

A third housing fitting portion 2104 capable of being coupled to the third housing 2150 is formed to protrude at left and right surfaces and a lower surface of the first housing 2110.

The second housing 2130 is illustrated in detail in FIGS. 5 and 6.

The second housing 2130 is formed in a plate shape.

A shaft insertion hole into which a latch pivoting shaft 2230, which is a rivet, is inserted is formed to be penetrated in the front-rear direction in the second housing 2130.

In the second housing 2130, a first protruding portion 2135, a second protruding portion 2136, and a third protruding portion 2137 are formed around a circumference of the shaft insertion hole so as to be recessed from the front to the rear. The first protruding portion 2135, the second protruding portion 2136, and the third protruding portion 2137 protrude further to the rear than other portions of a rear surface of the second housing 2130.

The first protruding portion 2135 comes into contact with a front surface of the latch 2200 and a front surface of the pivoting member 2370, which will be described below. Therefore, during assembly, friction between the latch 2200 and the pivoting member 2370 and the second housing 2130 may be minimized while the latch 2200 and the pivoting member 2370 do not move in the front-rear direction. That is, a portion protruding to the rear may be formed at the rear surface of the second housing 2130 so that friction with a member rotating with respect to the second housing 2130 is minimized. The first protruding portion 2135 is formed in an upside-down V-shape. The first protruding portion 2135 is formed to be curved in a rotating direction of the latch 2200 and the pivoting member 2370.

The second protruding portion 2136 is formed in an arc shape around the circumference of the shaft insertion hole and comes into contact with the front surface of the latch 2200. At the left side of the shaft insertion hole, a shaft insertion hole into which a first restoring spring catching shaft 2251, which is a rivet, is inserted is formed to be penetrated in the front-rear direction.

The third protruding portion 2137 is formed in the shape of an egg and is disposed at the right side of the first protruding portion 2135. A rivet insertion hole into which a pivoting shaft 2380 and a pivoting spring catching shaft 2391 are inserted is formed in the third protruding portion 2137 so as to be penetrated in the front-rear direction.

A plurality of door installation portions 2124 and 2134 are formed at the front surface of the first housing 2110 and the second housing 2130 so that the latch portion 2000 may be bolted and fastened to the vehicle door 1. The door installation portions 2124 and 2134 are disposed at upper and lower portions of the left sides of the first housing 2110 and the second housing 2130 and at the right side of the striker insertion groove 2105. The door installation portion 2124 formed at the first housing 2110 is formed in the shape of a groove which is recessed to the rear, and the door installation portion 2134 formed at the second housing 2130 is formed in the shape of a hole penetrating in the front-rear direction.

Further, an installation boss 2134*a* is formed at a rear surface of the second housing 2130 so as to protrude to the rear. The installation boss 2134*a* is inserted into the door installation portion 2124 of the first housing 2110. The installation boss 2134*a* is formed to surround the door installation portion 2134 formed at the second housing 2130. Screw threads are formed at an inner wall of the installation boss 2134*a*.

Thus, the latch portion 2000 may be easily and firmly installed at the vehicle door 1.

A cut portion corresponding to the striker insertion groove 2105 is formed in the second housing 2130 so that the striker insertion groove 2105 is open forward.

The second housing 2130 is installed at the front surface of the first housing 2110 via a plurality of bolts or the like.

In the second housing 2130, holes into which bolts are fastened are disposed at upper and lower portions of the left side and upper and lower portions of the right side with respect to the striker insertion groove 2105.

The third housing 2150 is illustrated in detail in FIGS. 7 and 8.

The third housing 2150 is formed in a plate shape whose edge protrudes to the front so that a space is formed at a front surface. The space of the third housing 2150 is formed to be open forward.

The third housing 2150 covers the rear surface of the first housing 2110 which is the opposite surface of the surface at which the latch 2200 is installed. That is, the second housing 2130 is coupled to the front surface of the first housing 2110, and the third housing 2150 is coupled to the rear surface of the first housing 2110.

The third housing 2150 is bolted and fastened to the rear surface of the first housing 2110.

First and second fastening portions 2121 and 2155 for bolting and fastening and the safety lever shaft 2109 are formed at the rear surface of the first housing 2110 and the third housing 2150.

The first fastening portion 2121 formed at the first housing 2110 is formed in the shape of a boss so as to protrude to the rear. The front of a hole into which a bolt is fastened that is formed in the first fastening portion 2121 is blocked. A rear end of the first fastening portion 2121 is formed to protrude further to the rear than the edge of the first housing 2110. Screw threads are formed at an inner circumferential surface of the first fastening portion 2121 during bolt assembly. The first fastening portion 2121 is disposed at a left side of the upper portion of the first housing 2110 and both sides of the lower portion thereof. The safety lever shaft 2109 is disposed at an upper portion of the right side of the first housing 2110. A guide boss 2122 is formed at an upper portion of the right side of the first housing 2110 so as to protrude to the rear. The guide boss 2122 is disposed further to the left than the safety lever shaft 2109. The guide boss 2122 is inserted into a through-hole of a worm gear 2614 which will be described below.

The second fastening portion 2155 formed at the third housing 2150 is formed in the shape of a through-hole penetrating in the front-rear direction. The second fastening portion 2155 is disposed to correspond to the first fastening portion 2121 and the safety lever shaft 2109 and is assembled to the first fastening portion 2121 and the safety lever shaft 2109.

A fourth protruding portion 2152 and a fifth protruding portion 2153*a* are formed at the central portion of the third housing 2150 so as to protrude to the front.

The fourth protruding portion 2152 is formed in a circular shape. The center of the fourth protruding portion 2152 and the center of the insertion hole 2535 of the lever 2530 coincide with each other. The fourth protruding portion 2152 comes into contact with the rear surface of the lever 2530. Therefore, during assembly, friction between the lever 2530 and the third housing 2150 may be minimized while the lever 2530 does not move in the front-rear direction.

The fifth protruding portion 2153*a* is formed to be curved in the rotating direction of the lever 2530. The fifth protruding portion 2153*a* is disposed at a lower portion of a left side of the fourth protruding portion 2152. The fifth protruding portion 2153*a* comes into contact with the rear surface of the lever 2530. Therefore, during assembly, friction between the lever 2530 and the third housing 2150 may be minimized while the lever 2530 does not move in the front-rear direction.

A lever guide portion 2153*b* is disposed at left and right sides below the fifth protruding portion 2153*a*. The lever guide portion 2153*b* is formed to be recessed from the front to the rear. A catching member fitting portion 2531 of the lever 2530 and the fixing portion 2522 of the cinching connecting portion 2520 are inserted into the lever guide portion 2153*b*. An upper portion of a left side of the lever guide portion 2153*b* is formed to be curved in the rotating direction of the catching member fitting portion 2531. A radius of rotation of the lever 2530 is limited by the catching portion guide groove 2115 and the lever guide portion 2153*b*.

A connecting portion cover installation groove 2156 is formed at the upper portion of the third housing 2150. The connecting portion cover installation groove 2156 is formed to be open forward. A connecting portion cover support portion 2157 is formed to protrude at upper and lower portions of the connecting portion cover installation groove 2156. Due to the connecting portion cover support portions 2157, when installing the connecting portion cover 2800 in the connecting portion cover installation groove 2156, friction is minimized and thus the installation is facilitated. The connecting portion cover support portion 2157 formed at the lower portion fixes the connecting portion cover 2800, prevents the open plate 2300 and the safety plate 2400 from falling off, and guides sliding of the open plate 2300 and the safety plate 2400 in the left-right direction. Since the rear of the connecting portion cover installation groove 2156 is blocked, the connecting portion cover 2800 is prevented from moving to the rear.

A first housing insertion groove 2158 into which the shaft 2106 of the first housing 2110 is inserted is formed in the center of the third housing 2150 so as to be recessed to the rear.

Connecting portion through-grooves 2159*a* and 2159*b* are formed at the upper and lower portions of the left side of the third housing 2150 so as to be open forward, leftward, and rightward.

The door lever connecting portion 40 and the door key connecting portion 50 are installed in the connecting portion through-groove 2159*a* at the upper portion. The connecting portion through-groove 2159*a* at the upper portion comes into communication with the connecting portion cover installation groove 2156.

The cinching connecting portion 2520 is installed in the connecting portion through-groove 2159*b* at the lower portion. The connecting portion through-groove 2159*b* at the lower portion comes into communication with the lever guide portion 2153*b*.

A wire connecting portion 2154*a* is formed at the upper portion of the rear of the third housing 2150 so as to protrude to the rear. The wire connecting portion 2154*a* is formed in a rounded rectangular shape which is hollow as a whole. A wire through-groove 2154*b* is formed in a central portion of the wire connecting portion 2154*a* so as to be penetrated in the front-rear direction. A wire 2750 enters the third housing 2150 from the outside through the wire through-groove 2154*b*.

A first housing fitting portion 2151 capable of being fitted to the third housing fitting portion 2104 of the first housing 2110 is formed at left and right surfaces and a lower surface of the third housing 2150. The first housing fitting portion 2151 is formed in a ring shape. Thus, the first housing fitting portion 2151 and the third housing fitting portion 2104 are fitted and coupled to each other such that the first housing 2110 and the third housing 2150 may be easily fastened to each other without bolting.

A rib is formed in a lattice shape at the rear surface of the third housing 2150. Thus, rigidity and durability of the third housing 2150 may be improved.

<Latch>

The latch 2200 is illustrated in detail in FIG. 9.

The latch 2200 is installed in the first housing 2110 so as to be disposed inside the latch installation groove 2111.

The latch 2200 is pivotally installed in the first housing 2110 through the latch pivoting shaft 2230 installed in the second housing 2130.

The latch 2200 is formed in a plate shape.

A locking groove 2201 is formed in an outer circumferential surface of the latch 2200.

The locking groove 2201 is formed to be penetrated in the front-rear direction and have an open outer end.

Due to the locking groove 2201, a second locking catching portion 2201*a*, which will be described below, at which a locking portion 2371 of the pivoting member 2370 is caught is formed at the latch 2200.

The locking groove 2201 has a width that gradually increases from the inside to the outside.

The locking groove 2201 is surrounded by a first surface 2203, a second surface 2205 which extends from a left side end of the first surface 2203 and is formed to be inclined, and a third surface 2207 which extends from a left side end of the second surface 2205 and is formed in an arc shape so as to surround the striker.

The first surface 2203 forms an upper surface of the second locking catching portion 2201*a*.

A striker catching protrusion 2204 at which the striker is caught is formed at the latch 2200.

The striker catching protrusion 2204 is disposed inside the locking groove 2201 so that the striker is effectively prevented from falling off after being inserted into the locking groove 2201.

The striker catching protrusion 2204 is formed at a surface facing a surface at which the first surface 2203 is formed (a surface at which the locking portion 2371 is caught).

Since a surface of the striker catching protrusion 2204 that faces the striker when the striker is inserted into the locking groove 2201 and a surface of the striker catching protrusion 2204 that faces the striker when the striker is withdrawn from the locking groove 2201 are formed to be inclined, the striker may be smoothly inserted into the locking groove 2201.

An auxiliary locking groove 2202 is formed at a lower portion of the locking groove 2201 in the latch 2200. The auxiliary locking groove 2202 is formed in a shape similar to that of the locking groove 2201 while having a shallower depth than the locking groove 2201. That is, a distance between the auxiliary locking groove 2202 and the center of rotation of the latch 2200 is larger than a distance between the locking groove 2201 and the center of rotation of the latch 2200.

When closing the vehicle door 1, the locking portion 2371 is inserted into the auxiliary locking groove 2202 at first and then inserted into the locking groove 2201.

The locking groove 2201 and the auxiliary locking groove 2202 are disposed to be spaced apart from each other in a circumferential direction. Thus, a passenger may recognize the process in which the vehicle door 1 is being closed by the cinching module 2500 during use of the cinching function. Also, even when locking is not performed in the locking groove 2201, since the auxiliary locking groove 2202 holds the vehicle door 1, there is an advantage in that safety of locking is improved.

Meanwhile, due to the auxiliary locking groove 2202, a first locking catching portion 2202*a*, which will be described below, at which the locking portion 2371 is caught is formed in the latch 2200.

Further, the latch 2200 is surrounded by an elastic cover 2206. An outer surface of the latch 2200 may be covered with the elastic cover 2206 through insert injection. The elastic cover 2206 is formed of a material having elasticity such as rubber and serves to absorb impact applied to the latch 2200 and prevent noise. The elastic cover 2206 surrounds the first locking catching portion 2202*a*, the second locking catching portion 2201*a*, and the entire latch 2200 except for portions thereof in contact with the first restoring spring catching shaft 2251 and the first restoring spring 2250.

The latch pivoting shaft 2230 is inserted into a central portion of the elastic cover 2206. In the elastic cover 2206, an elastic cover groove 2208 is formed in a side surface into which the latch pivoting shaft 2230 is inserted. The elastic cover groove 2208 is formed to be recessed in a longitudinal direction of the side surface. Thus, friction force generated between the elastic cover 2206 and the latch pivoting shaft 2230 when the elastic cover 2206 is pivoted is reduced such that the durability is further improved. Also, since, due to the elastic cover groove 2208, lubricant (grease) may be accommodated in the elastic cover groove 2208 for a long time, the performance is improved.

A slit 2209 is formed in the elastic cover 2206. In the latch 2200, the slit 2209 is formed in a portion abutting the bumper member 2360 which is disposed at the upper portion, a portion abutting the striker, a portion abutting the first restoring spring catching shaft 2251, and the like. When the latch 2200 abuts another member, impact may be absorbed due to the slits 2209.

A spring fitting portion 2213 is formed at the outer circumferential surface of the latch 2200.

The spring fitting portion 2213 is formed in the shape of a groove or a hole. In the present embodiment, the spring fitting portion 2213 is formed in the shape of a groove.

A protrusion 2215 is formed at an outer circumferential surface of a left side of the latch 2200 so as to protrude to the outside.

The protrusion 2215 is disposed at the front of the catching portion guide groove 2115.

The locking groove 2201, the auxiliary locking groove 2202, the spring fitting portion 2213, and the protrusion 2215 are disposed in that order in a direction (clockwise) in which the latch 2200 rotates when the vehicle door 1 is being closed.

The first restoring spring 2250 is provided so that the latch 2200 is automatically restored when the locking is released.

First and second bent portions 2252 and 2253 which are bent corresponding to the shape of an assembly portion are formed at one end and the other end of the first restoring spring 2250. For example, the first bent portion 2252 is bent upward at a right angle, and the second bent portion 2253 is bent forward at a right angle.

The first bent portion 2252 of the first restoring spring 2250 is caught at the first restoring spring catching shaft 2251, a coil portion of the first restoring spring 2250 is wound around the latch pivoting shaft 2230, and the second bent portion 2253 is fitted into the spring fitting portion 2213 of the latch 2200. Since the first and second bent portions 2252 and 2253 are formed at the first restoring spring 2250 in this way, assemblability is further improved.

When the latch 2200 rotates, the other end of the first restoring spring 2250 is rotated together with the latch 2200.

<Pivoting Member>

The pivoting member 2370 is illustrated in detail in FIG. 10. The pivoting member 2370 is also referred to as "pawl."

The pivoting member 2370 interlocks with the open lever 2350.

The pivoting member 2370 is disposed at the front side of the first housing 2110 and is pivotally installed in the second housing 2130 by the pivoting shaft 2380 disposed in the front-rear direction.

The pivoting shaft 2380 is installed to pass through the upper portion of the pivoting member 2370.

A rivet is provided as the pivoting shaft 2380, and the pivoting shaft 2380 is riveted in the second housing 2130.

The pivoting member 2370 may pivot clockwise or counterclockwise about the pivoting shaft 2380.

Also, the pivoting member spring 2390 configured to restore the pivoting member 2370 may be provided.

Like the first restoring spring 2250, the pivoting member spring 2390 is also a coil spring, and first and second bent portions 2392 and 2393 which are bent corresponding to the shape of the assembly portion are formed at both ends of the pivoting member spring 2390. For example, the first bent portion 2392 is bent upward at a right angle, and the second bent portion 2393 is bent forward at a right angle.

The first bent portion 2392 of the pivoting member spring 2390 is supported and fixed by the pivoting spring catching shaft 2391 which is riveted in the second housing 2130, and the second bent portion 2393 is caught and connected at a spring fitting portion 2375 formed at the right side of the pivoting member 2370. A coil portion of the pivoting member spring 2390 is fitted to the pivoting shaft 2380.

The spring fitting portion 2375 may be formed in the shape of a groove or a hole. In the present embodiment, the spring fitting portion 2375 is formed in the shape of a groove.

When a force is applied to the pivoting member 2370 such that the pivoting member 2370 is pushed counterclockwise and then released, the pivoting member spring 2390 serves to allow the pivoting member 2370 to be restored to its default position by giving an elastic force that causes the pivoting member 2370 to pivot clockwise.

The pivoting member 2370 is formed of the locking portion 2371 and a catching protrusion 2373.

The locking portion 2371 is formed at a lower portion of a left side of the pivoting member 2370 so as to protrude to the left side.

The locking portion 2371 serves to restrict (lock) the position of the latch 2200, thereby allowing the closed state of the vehicle door 1 to be maintained.

A latch insertion groove 2372 into which a portion (the first surface 2203) of an end of the latch 2200 and the auxiliary locking groove 2202 are inserted while the vehicle door 1 is closed is formed in the lower portion of the locking portion 2371. The latch insertion groove 2372 is formed to be open downward and is disposed between the locking portion 2371 and the catching protrusion 2373. Due to the latch insertion groove 2372, the state in which the latch 2200 is locked to the pivoting member 2370 is stably maintained while the vehicle door 1 is closed.

The catching protrusion 2373 is formed at the right side of the lower surface of the locking portion 2371 so as to protrude downward.

A pivoting member catching portion 2351 of the open lever 2350 is inserted into a left side of the catching protrusion 2373. That is, the catching protrusion 2373 serves to cause the pivoting member 2370 to pivot according to rotation of the open lever 2350.

The pivoting member 2370 is rotated by interlocking with rotation and movement of the open lever 2350.

Also, as in the latch 2200 described above, an elastic cover 2374 is also provided at the pivoting member 2370. The elastic cover 2374 is formed of a material having elasticity such as rubber and serves to absorb impact applied to the pivoting member 2370 and prevent noise. The elastic cover 2374 is formed to surround the entire pivoting member 2370 except for the locking portion 2371 thereof.

A groove is also formed in the elastic cover 2374 of the pivoting member 2370 so as to be recessed in the longitudinal direction at a side surface of a central portion. Thus, friction force generated between the elastic cover 2374 and the pivoting shaft 2380 when the elastic cover 2374 is pivoted is reduced such that the durability is further improved. Also, since, due to the groove, lubricant (grease) may be accommodated in the groove for a long time, the performance is improved.

A slit 2376 is also formed in the elastic cover 2374 of the pivoting member 2370.

The slit 2376 is formed in a portion abutting the open lever 2350. Specifically, the slit 2376 is disposed between the locking portion 2371 and the catching protrusion 2373. When the pivoting member 2370 is restored by the pivoting member spring, even when the pivoting member 2370 and the open lever 2350 abut each other, impact is absorbed by the slit 2376.

<Open Lever>

The open lever 2350 is illustrated in detail in FIG. 10.

The open lever 2350 is rotatably installed at the shaft 2106 formed at the rear surface of the first housing 2110. That is, the open lever 2350 is installed at the opposite surface of the surface at which the latch 2200 is installed in the first housing 2110.

The open lever 2350 is formed in a plate shape.

The open lever 2350 is formed in the shape in which a lower side is bent forward in a stair shape and an upper side is bent rearward in a stair shape with respect to the portion where the hole into which the shaft 2106 is fitted is formed.

The pivoting member catching portion 2351 configured to abut the left side of the catching protrusion 2373 of the pivoting member 2370 is formed at a front surface of the open lever 2350 so as to protrude to the front. The pivoting member catching portion 2351 is exposed to the front through the pivoting member catching portion through-hole 2118.

A detecting portion 2352 is formed at the rear surface of the open lever 2350 so as to protrude to the rear. The detecting portion 2352 is formed to be able to press a third sensor 2903 installed below the detecting portion 2352.

An open catching portion 2353 at which a first rotation catching portion 2617 and a second rotation catching portion 2618 of a locking member 2615 are caught is formed at an upper portion of the open lever 2350. Thus, when the locking member 2615 rotates, the open lever 2350 also rotates as a result.

An open catching protrusion 2354 configured to be inserted into the open plate 2300 is formed at a rear surface of the open catching portion 2353 so as to protrude to the rear. Thus, when the open plate 2300 slides, the open lever 2350 rotates as a result.

<Driving Portion>

The driving portion is illustrated in detail in FIGS. 11 to 14.

The driving portion includes the motor 2610, the worm gear 2614 rotated by the motor 2610, the locking member 2615 configured to simultaneously rotate with the worm gear 2614, and the safety plate 2400 inserted into the locking member 2615.

The driving portion is disposed at the upper portion of the rear of the first housing 2110. The driving portion is disposed between the first housing 2110 and the third housing 2150.

A worm 2613 is installed at the shaft of the motor 2610.

The worm 2613 is engaged with the worm gear 2614. The worm gear 2614 is disposed at an upper portion of the worm 2613.

The worm gear 2614 and the locking member 2615 are integrally formed. The locking member 2615 is formed at the rear of the worm gear 2614.

A safety plate fitting groove 2616 into which a locking fitting portion 2403 of the safety plate 2400 that will be described below is inserted is formed in an upper portion of the locking member 2615. Two rotation catching portions at which the open catching portion 2353 of the open lever 2350 is caught are formed at both sides of a lower portion of the locking member 2615 so as to be spaced apart from each other in the circumferential direction.

The rotation catching portions include the first rotation catching portion 2617 and the second rotation catching portion 2618.

Due to the rotation catching portions, when the locking member 2615 is rotated, the open lever 2350 is rotated clockwise or counterclockwise.

<Safety Actuator>

The safety actuator is illustrated in detail in FIGS. 11 to 14.

The safety actuator includes the safety motor 2620, a worm 2621 rotated by the safety motor 2620, the safety valve 2630 configured to slide in the left-right direction by the worm 2621, and the safety lever 2640 rotated by the safety valve.

The safety actuator is disposed at the lower portion and the right side of the driving portion.

The worm 2621 is installed at the shaft of the safety motor 2620.

The safety valve 2630 includes a female screw portion 2632 fitted to the worm 2621, a sliding valve 2631 formed at the front and the rear of the female screw portion 2632, and a safety lever fitting portion 2633 formed at an upper portion of the front of the female screw portion 2632.

The female screw portion 2632 is formed in a cylindrical shape whose central portion is penetrated in the left-right direction as a whole. A rectangular valve is formed to protrude at an upper portion and a lower portion of the female screw portion 2632 so that the sliding valve 2631 may be installed.

The inside of the female screw portion 2632 is engaged with the worm 2621.

The sliding valve 2631 is formed at the center and the lower portion at the front of the female screw portion 2632 and is formed at the center and the upper and lower portions at the rear of the female screw portion 2632. The sliding valve 2631 is formed to protrude to the front or the rear in the longitudinal direction of the female screw portion 2632.

The sliding valve 2631 formed at the front is inserted into the third guide portion 2103 of the first housing 2110, and the sliding valve 2631 formed at the rear is inserted into a fourth guide portion 2731 of an insert plate 2700 which will be described below.

Thus, when the worm 2621 rotates, the safety valve 2630 slides in the left-right direction instead of being rotated.

The safety lever fitting portion 2633 is formed to protrude to the front. The safety lever 2640 is inserted into the safety lever fitting portion 2633 such that the safety lever 2640 is rotated due to the sliding of the safety valve 2630 in the left-right direction.

The safety lever 2640 is formed in the shape in which a wing portion protrudes from both sides of a donut-shaped valve.

The donut-shaped valve is fitted to the safety lever shaft 2109 of the first housing 2110 and rotates about the safety lever shaft 2109.

A hole into which the safety lever fitting portion 2633 of the safety valve 2630 may be inserted and a hole into which a safety lever fitting portion 2404 of the safety plate 2400 which will be described below may be inserted are respectively formed in the wing portions.

Thus, when the safety motor 2620 rotates and the safety valve 2630 moves rightward, the safety lever 2640 rotates counterclockwise, and, when the safety valve 2630 moves leftward, the safety lever 2640 rotates clockwise.

<Safety Plate>

The safety plate 2400 is illustrated in detail in FIGS. 11 to 14.

The safety plate 2400 is formed in the shape of a quadrilateral bar as a whole. A right side portion of the safety plate 2400 is formed to protrude to the front.

A safety plate detection protrusion 2402 is formed at the center of the safety plate 2400 so as to protrude to the lower side. Due to the safety plate detection protrusion 2402, the safety plate 2400 is detected by a fourth sensor 2904 to which electricity is applied during operation of the safety motor 2620.

The locking fitting portion 2403 inserted into the locking member 2615 is formed at the central portion of the safety plate 2400 so as to protrude to the lower side. While the safety motor 2620 rotates in a reverse direction, the locking fitting portion 2403 is inserted into the safety plate fitting groove 2616 of the locking member 2615 so that rotation of the locking member 2615 in an opening direction is inhibited.

A stopper installation portion 2410 is formed at the left side of the safety plate 2400. The stopper installation portion 2410 is formed to protrude further downward than other portions of the safety plate 2400. When the vehicle door 1 has a retractable handle, instead of connecting a safety actuator 1000 to the latch portion 2000, the latch portion 2000 and the retractable handle may be mechanically connected through the stopper installation portion 2410.

The stopper installation portion 2410 includes a cover fitting portion 2401, a stopper fitting groove 2411, a stopper catching portion 2412, and a spring fitting portion 2413.

The cover fitting portion 2401 is formed to protrude upward at both front and rear sides of an upper portion of the stopper installation portion 2410. The cover fitting portion 2401 is inserted into the connecting portion cover 2800, thereby preventing the safety plate 2400 from moving in the front-rear direction and limiting the sliding width of the safety plate 2400 in the left-right direction.

The stopper fitting groove 2411 is formed to be open upward.

The stopper catching portion 2412 is formed to be open upward and have a right side that comes into communication with the left side of the stopper fitting groove 2411. That is, the stopper catching portion 2412 is disposed at the left side of the stopper fitting groove 2411.

The spring fitting portion 2413 is formed at the left side of the stopper installation portion 2410 so as to protrude to the left side. A stopper spring 35 is installed at the spring fitting portion 2413 such that the stopper spring 35 may be used when a lever connected to the handle is installed.

A groove is formed in the spring fitting portion 2413 so as to be open upward. A front-rear width of the groove is equal or similar to the front-rear width of the stopper catching portion 2412, and the groove comes into communication with the stopper catching portion 2412.

The safety lever fitting portion 2404 is formed at the front of the right side of the safety plate 2400 so as to protrude to the front. An upper portion of the safety lever 2640 is inserted into the safety lever fitting portion 2404 such that the safety plate 2400 slides in the left-right direction according to a direction in which the safety lever 2640 rotates.

The safety plate 2400 is disposed at the upper portion of the rear of the motor 2610.

<Open Plate>

The open plate 2300 is illustrated in detail in FIGS. 15 to 17.

A curved portion 2302 is formed at the open plate 2300 so that a right side of the open plate 2300 is bent forward. An open lever fitting portion 2303 is formed at the front of the curved portion 2302 so as to protrude downward. The open lever fitting groove 2304 is formed in the open lever fitting portion 2303 so as to be penetrated in the front-rear direction. Since the left-right and up-down widths of the open lever fitting groove 2304 are formed slightly larger than the radius of rotation of the open lever 2350, the open lever 2350 may pivot within the open lever fitting groove 2304.

A stopper installation portion 2310 at which the door lever connecting portion 40 and the door key connecting portion 50 are installed is formed at a left side of the open plate 2300. The stopper installation portion 2310 is formed to protrude further upward than other portions of the open plate 2300.

The stopper installation portion 2310 includes a cover fitting portion 2301, stopper fitting grooves 2311, stopper catching portions 2312, and spring fitting portions 2313.

The cover fitting portion 2301 is formed to protrude upward at both front and rear sides of an upper portion of the stopper installation portion 2310. The cover fitting portion 2301 is inserted into the connecting portion cover 2800, thereby preventing the open plate 2300 from moving in the front-rear direction and limiting the sliding width of the open plate 2300 in the left-right direction.

The stopper fitting groove 2311 is formed at both sides in the front-rear direction so as to be open upward. A stopper 44 of the door lever connecting portion 40 and a stopper 54 of the door key connecting portion 50 are respectively fitted into the stopper fitting grooves 2311, and a left-right length of the stopper fitting grooves 2311 is formed to be larger than a left-right length of the stoppers 44 and 54 so that the stoppers 44 and 54 may slide in the left-right direction. Thus, even when cables 43 and 53 are bent and thus the stoppers 44 and 54 move or when a stroke error occurs during assembly of the door lever connecting portion 40 and the door key connecting portion 50, it is possible to actively deal with such situations.

The stopper catching portions 2312 are formed to be open upward and have a right side that comes into communication with the left side of each stopper fitting groove 2311. That is, the stopper catching portion 2312 is disposed at the left side of each stopper fitting groove 2311. The cable 43 of the door lever connecting portion 40 and the cable 53 of the door key connecting portion 50 are respectively installed at the stopper catching portions 2312. A front-rear width of the stopper catching portions 2312 is formed to be smaller than a front-rear length of the stoppers 44 and 54 so that the stoppers 44 and 54 are prevented from falling off to the left side from the stopper fitting grooves 2311.

The spring fitting portion 2313 is formed at both sides in the front-rear direction at the left side of the stopper installation portion 2310 so as to protrude to the left side. A stopper spring 45 of the door lever connecting portion 40 and a stopper spring 55 of the door key connecting portion 50 are respectively installed at the spring fitting portions 2313.

A groove is formed in the spring fitting portion 2313 so as to be open upward. A front-rear width of the groove is equal or similar to the front-rear width of the stopper catching portion 2312, and the groove comes into communication with the stopper catching portion 2312.

When a lever installed inside the vehicle door 1 and connected to the door lever connecting portion 40 is pulled or a key is inserted into the key cylinder, which is installed outside the vehicle door 1, and rotated such that the door key connecting portion 50 is pulled in case of emergency where a motor has failed or power is not supplied, the open plate 2300 slides such that the vehicle door 1 is opened. The lever may be differently disposed for each seat according to a customer's policies. For example, the lever may be disposed only at a driver's seat without being disposed at a passenger seat and a backseat.

<Cinching Module>

The cinching module 2500 is illustrated in detail in FIGS. 18 and 19.

The cinching module 2500 includes an actuator 2510, the cinching connecting portion 2520 slidably installed at the actuator 2510, and the lever 2530 configured to interlock with the cinching connecting portion 2520.

The actuator 2510 includes a driving portion configured to rotate the latch 2200 so that the latch 2200 is locked by the pivoting member 2370. The driving portion includes a motor (not illustrated) and a gear portion (not illustrated) rotated by the motor.

Specifications of the actuator 2510 may be changed according to vehicles, and the actuator 2510 may be installed outside the latch portion 2000. Thus, the latch portion 2000 may have the same size regardless of the specifications of the actuator 2510, and the actuator 2510 may be easily removed according to a customer's need.

A cable of a wire member such as a wire is provided as the cinching connecting portion 2520. An outer circumferential surface of the cinching connecting portion 2520 is surrounded by a protective tube. One end of the cinching connecting portion 2520 is connected to the actuator 2510. The fixing portion 2522 having a groove formed around a circumference thereof is formed at the other side of the protective tube so as to be fitted and fixed to the cinching connecting portion installation portion 2119 of the first housing 2110. A catching member 2521 is formed at the other end of the cinching connecting portion 2520 and fitted to the lever 2530 which will be described below. Thus, when the cinching connecting portion 2520 moves, the protective tube does not move, and only the cable moves.

The cinching connecting portion 2520 transmits a driving force of the actuator 2510 to the lever 2530.

Due to the cinching connecting portion 2520, a position of the actuator 2510 relative to the latch portion 2000 may be freely adjusted.

The lever 2530 is formed in a fan shape as a whole and fitted into the lever shaft 2114 of the first housing 2110. Since the lever 2530 and the first housing 2110 are coupled in the form of being simply fitted to each other, the lever 2530 may be easily removed from the latch portion 2000. The lever 2530 is disposed between the first housing 2110 and the third housing 2150.

The catching member fitting portion 2531 into which the catching member 2521 of the cinching connecting portion 2520 is fitted, a latch catching portion 2532 at which a lower end of the latch 2200 is caught, and a lever protrusion 2534 which comes into contact with the first housing 2110 are formed at the lever 2530.

The lever protrusion 2534 may be formed of an arc-shaped plate and minimize friction between the lever 2530 and the first housing 2110.

The insertion hole 2535 into which the lever shaft 2114 is fitted is formed at an upper portion of the lever 2530 such that the lever 2530 rotates about the insertion hole 2535. The center of the insertion hole 2535 is disposed to be collinear with a rotating shaft of the latch 2200.

The catching member fitting portion 2531 is formed at a right side of the lever 2530 so as to protrude to the rear. The catching member fitting portion 2531 is formed to be open rearward and downward and have an open central portion at a left side thereof. The catching member fitting portion 2531 is formed in a shape similar to that of the catching member 2521. Thus, the catching member 2521 and the cinching connecting portion 2520 are inserted through a lower portion of the catching member fitting portion 2531 and installed so that the cinching connecting portion 2520 is placed at a left side of the catching member fitting portion 2531.

The catching member fitting portion 2531 is inserted into the lever guide portion 2153*b* formed in the front of the third housing 2150.

The Latch Catching Portion 2532 is Formed at a Left Side of the Lever 2530 so as to protrude to the front. The latch catching portion 2532 is formed to be curved along the circumferential shape of the lever 2530. A latch catching portion protrusion 2533 may be formed to protrude from a lower portion of the latch catching portion 2532. A sensor capable of detecting the latch catching portion protrusion 2533 may be further provided so that a position of the lever 2530 may be detected. Separately, the latch catching portion 2532 interlocks with the actuator 2510 such that it is possible to control a cinching stroke inside the actuator 2510 itself.

<Connecting Portion Cover>

The connecting portion cover 2800 is illustrated in detail in FIGS. 20 and 21.

The connecting portion cover 2800 is formed in a rectangular parallelepiped shape as a whole. A front portion of the connecting portion cover 2800 is inserted into the first connecting portion cover installation portion 2126 of the first housing 2110, and a rear portion of the connecting portion cover 2800 is inserted into the connecting portion cover installation groove 2156 of the third housing 2150. That is, the connecting portion cover 2800 is disposed between the first housing 2110 and the third housing 2150.

Since portions of the left side and the right side of the connecting portion cover 2800 are blocked by the first connecting portion cover installation portion 2126 of the first housing, the connecting portion cover 2800 is prevented from sliding in the left-right direction.

At a right side of the front of the connecting portion cover 2800, a housing interference prevention groove 2809 is formed at a lower portion. The housing interference prevention groove 2809 is formed to be recessed to the rear and prevents interference between the door installation portion 2124 of the first housing 2110 and the connecting portion cover 2800.

A catching groove 2801 is formed in the left-right direction at an upper portion of the right side of the connecting portion cover 2800. The catching groove 2801 is formed to be penetrated in the up-down direction. The cover fitting portion 2301 of the open plate 2300 and the cover fitting portion 2401 of the safety plate 2400 are inserted into the catching groove 2801. Due to the catching groove 2801, the open plate 2300 and the safety plate 2400 slide only within a left-right length of the catching groove 2801.

A safety plate guide groove 2802 and an open plate guide groove 2803 are formed at a lower portion of the right side of the connecting portion cover 2800 so as to be open rightward and downward. The upper potion and left and right sides of the safety plate 2400 are guided by the safety plate guide groove 2802. The upper portion and left and right sides of the open plate 2300 are guided by the open plate guide groove 2803.

A plurality of connecting portion through-grooves 2806 are formed at a lower portion of a left side of the connecting portion cover 2800 so as to be open in the left-right direction and downward. The door lever connecting portion 40 and the door key connecting portion 50 are installed in the connecting portion through-grooves 2806. A front-rear width of the connecting portion through-groove 2806 is equal or similar to the outer diameter of the tubes of the door lever connecting portion 40 and the door key connecting portion 50.

A first connecting portion seating groove 2804 is formed at a right side of the connecting portion through-grooves 2806 so as to be open downward. A left side of the first connecting portion seating groove 2804 comes into communication with the connecting portion through-grooves 2806. Portions of the stopper fixing portions 46 and 56 are inserted into the first connecting portion seating groove 2804.

A plurality of fixing portion installation grooves 2807 are formed at a right side of the first connecting portion seating groove 2804 so as to be open in the left-right direction and downward. A left side of the fixing portion installation grooves 2807 comes into communication with the first connecting portion seating groove 2804. Grooves of the stopper fixing portions 46 and 56 are inserted into the fixing portion installation grooves 2807. A front-rear width of the fixing portion installation groove 2807 is equal or similar to an outer diameter of the groove, and a left-right length of the fixing portion installation groove 2807 is equal or similar to a left-right length of the groove so that the stopper fixing portions 46 and 56 are prevented from moving in the left-right and front-rear directions.

A second connecting portion seating groove 2805 is formed at a right side of the fixing portion installation grooves 2807 so as to be open downward. A left side of the second connecting portion seating groove 2805 comes into communication with the fixing portion installation grooves 2807. Portions of the stopper fixing portions 46 and 56 are inserted into the second connecting portion seating groove 2805.

Cable through-grooves 2808 are formed at a right side of the second connecting portion seating groove 2805 so as to be open in the left-right direction and downward. A left side of the cable through-groove 2808 comes into communication with the second connecting portion seating groove 2805, and a right side of the cable through-groove 2808 comes into communication with the safety plate guide groove 2802 and the open plate guide groove 2803. The cable 43 of the door lever connecting portion 40 installed at the open plate 2300 and the cable 53 of the door key connecting portion 50 are respectively installed in the cable through-grooves 2808. A front-rear width of the cable through-groove 2808 is formed to be smaller than an outer diameter of the stopper springs 35, 45, and 55 so that the stopper springs 35, 45, and 55 are prevented from moving leftward.

<Insert Plate>

The insert plate 2700 is illustrated in detail in FIGS. 22 to 24.

The insert plate 2700 is formed in a plate shape as a whole.

The insert plate 2700 covers rear surfaces of the driving portion and the safety actuator. That is, the insert plate 2700 is disposed between both the driving portion and the safety actuator and the third housing 2150.

The insert plate 2700 is fitted between both the first fastening portion 2121 and the safety lever shaft 2109 of the first housing 2110 and the third housing 2150 such that the insert plate 2700 is bolted and fastened together with the first housing 2110 and the third housing 2150.

A first-and-second sensor installation portion 2701 and a third sensor installation portion 2703 are formed at a lower portion of the insert plate 2700. The first-and-second sensor installation portion 2701 and the third sensor installation portion 2703 are formed to be open forward and upward, and grooves through which the wire 2750 may be withdrawn are disposed at lower portions of the first-and-second sensor installation portion 2701 and the third sensor installation portion 2703 such that the wire is connected to first, second, and third sensors 2901, 2902, and 2903 through the grooves.

A first-and-second sensor installation valve 2702 is formed at the center of the first-and-second sensor installation portion 2701 so as to protrude to the front. Thus, the first sensor 2901 and the second sensor 2902 may be respectively installed at a left side and a right side of the first-and-second sensor installation portion 2701.

An open plate installation groove 2710 is formed at an upper portion of the insert plate 2700. The open plate installation groove 2710 is formed to be open forward.

An open plate support portion 2712 is formed at an upper portion of the open plate installation groove 2710 so as to protrude downward. Due to the open plate support portion 2712, when installing the open plate 2300 in the open plate installation groove 2710, friction is minimized and thus the installation is facilitated. Also, the open plate support portion 2712 guides sliding of the open plate 2300 in the left-right direction.

At the left side of the open plate installation groove 2710, an open plate through-groove 2711 is formed so as to be open forward and be penetrated in the left-right direction. The open plate 2300 is installed in the open plate through-groove 2711. The open plate through-groove 2711 comes into communication with the connecting portion cover installation groove 2156 of the third housing 2150.

An open plate guide portion 2713 is formed at the upper portion of the insert plate 2700. The open plate guide portion 2713 is formed to be open forward and upward. That is, the open plate guide portion 2713 is formed so that left and right sides, a lower portion, and a rear portion thereof are blocked.

The open plate guide portion 2713 is disposed at the front of the lower portion of the open plate installation groove 2710. The open lever fitting portion 2303 of the open plate 2300 is inserted into the open plate guide portion 2713. The open plate 2300 is installed such that a front surface of the open plate guide portion 2713 and a rear surface of the open lever fitting portion 2303 come into contact with each other. Thus, the open plate guide portion 2713 guides sliding of the open plate 2300 in the left-right direction.

A safety plate support portion 2715 is formed at a right side of the open plate guide portion 2713 so as to protrude to the front. The safety plate support portion 2715 is formed in an L-shape in which an upper portion is bent rightward.

When the open plate 2300 slides rightward, a left side surface of the safety plate support portion 2715 comes into contact with a right side surface of the open plate 2300, thereby inhibiting sliding of the open plate 2300. A right side surface of the safety plate support portion 2715 comes into contact with a left side surface of the fourth sensor 2904.

An upper surface of the bent portion at the upper portion of the safety plate support portion 2715 comes into contact with a portion of a lower surface of the safety plate 2400, thereby guiding sliding of the safety plate 2400 in the left-right direction. A lower surface of the bent portion comes into contact with a portion of an upper surface of the fourth sensor 2904, thereby preventing the fourth sensor 2904 from falling off to the top.

A safety plate through-groove 2714 is formed at a right side of the open plate installation groove 2710 so as to be open forward and be penetrated in the left-right direction. The safety plate through-groove 2714 is disposed further to the top than the open plate through-groove 2711. The safety plate 2400 is installed in the safety plate through-groove 2714.

A fourth sensor installation portion 2704 at which the fourth sensor 2904 is installed is formed at an upper portion of the center of the insert plate 2700. The fourth sensor installation portion 2704 is disposed at a right side of the open plate installation groove 2710 and the open plate guide portion 2713. The fourth sensor installation portion 2704 is formed to be open forward and upward.

A fourth sensor fitting protrusion 2705 is formed at the center of the fourth sensor installation portion 2704 so as to protrude to the front, thereby preventing the fourth sensor 2904 from moving in the up-down and left-right directions.

A fourth sensor support portion 2706 is formed at a lower portion of the fourth sensor installation portion 2704 so as to protrude to the front, thereby simultaneously supporting a lower portion of the fourth sensor 2904, minimizing friction generated when the fourth sensor 2904 is being installed, and securing a space in which the wire 2750 may be connected to the fourth sensor 2904 after being withdrawn through a groove.

A motor installation portion 2720 is formed at an upper portion of a right side of the insert plate 2700. A front surface of the motor installation portion 2720 is formed to come into contact with a rear surface of the motor 2610.

A motor shaft support portion 2721 is formed at an upper portion of a left side of the motor installation portion 2720 so as to protrude to the front. The motor shaft support portion 2721 is formed in the shape of a quadrilateral plate. The front of the motor shaft support portion 2721 is formed to be sunken in a semicircular shape so that the shaft of the motor 2610 may be placed therein. Due to the motor shaft support portion 2721 and the first housing 2110, the shaft of the motor 2610 is prevented from shaking in the front-rear and up-down directions.

A safety motor installation portion 2730 is formed at a lower portion of a right side of the insert plate 2700. A front surface of the safety motor installation portion 2730 is formed to come into contact with a rear surface of the safety motor 2620.

The fourth guide portion 2731 is formed at a right side of the safety motor installation portion 2730 so as to protrude to the front. The fourth guide portion 2731 is formed longitudinally in the left-right direction. The fourth guide portion 2731 is formed in plurality in the up-down direction. A lower surface of the sliding valve 2631 formed at an upper portion of the safety valve 2630 comes into contact with an upper surface of the fourth guide portion 2731 formed at an upper portion, the sliding valve 2631 formed at the center of the safety valve 2630 is inserted between two fourth guide portions 2731 formed at the center, and an upper surface of the sliding valve 2631 formed at a lower portion of the safety valve 2630 comes into contact with a lower surface of the fourth guide portion 2731 formed at a lower portion.

Due to the fourth guide portions 2731, sliding of the safety valve 2630 in the left-right direction is guided.

A third fastening portion 2707 is formed at a right side of the motor installation portion 2720 of the insert plate 2700, a left side of the first-and-second sensor installation portion 2701, and between the first-and-second sensor installation portion 2701 and the third sensor installation portion 2703.

The third fastening portion 2707 is formed in the shape in which a circular band protrudes to the front. The first fastening portion 2121 of the first housing 2110 and a portion of the rear of the safety lever shaft 2109 are inserted into a space formed inside the band.

A hole is formed at the center of the third fastening portion 2707 so as to be penetrated in the front-rear direction so that a bolt is fastened through the hole to the first fastening portion 2121 of the first housing 2110 and the safety lever shaft 2109.

A shaft through-groove 2708 is formed in a central portion of the insert plate 2700 so as to be penetrated in the front-rear direction. The shaft 2106 of the first housing 2110 is inserted into the shaft through-groove 2708. That is, the rear of the shaft 2106 is supported by the shaft through-groove 2708.

A wire connecting portion 2740 is formed at an upper portion of a left side of the insert plate 2700 so as to protrude to the rear. An insert terminal is formed inside the insert plate 2700. The wire 2750 connected to the wire connecting portion 2740 is installed inside the insert plate 2700 through insert injection. The wire 2750 is exposed to the outside of the insert plate 2700 through a groove formed in a portion at which the wire 2750 has to be connected.

A rib is formed in a lattice shape at the rear surface of the right side of the insert plate 2700. Thus, rigidity of the insert plate 2700 may be improved.

<Control Portion>

The present embodiment includes a door lock state input portion configured to receive information on whether the vehicle door 1 is locked, a driving state input portion configured to receive information on whether the driving portion is driven, a sensor, and the control portion configured to receive signals from the door lock state input portion, the driving state input portion, and the sensor and control the driving portion.

The door lock state input portion may be disposed in the form of a button, a switch, or the touch sensor 2 on the vehicle door 1 or a vehicle remote controller.

The door lock state input portion which is provided at a front door of the vehicle may include a central lock switch, a central unlock switch, a child lock switch, and a child unlock switch. The central lock switch is used when setting all doors to be locked, the central unlock switch is used to unlock all the doors, the child lock switch is used to make both back doors unopenable from inside the vehicle, and the child unlock switch is used to make both back doors openable from inside the vehicle.

The door lock state input portion which is provided at a rear door of the vehicle may include a door lock switch and a door unlock switch. The door lock switch is used when setting the corresponding door to be locked, and the door unlock switch is used to unlock the corresponding door.

The door lock state input portion provided at the vehicle remote controller includes the central lock switch, the central unlock switch, a dead lock switch and a dead unlock switch. The dead lock switch is used when setting all the doors to be unopenable from inside and outside the vehicle, and the dead unlock switch is used when setting all the doors to be openable from inside and outside the vehicle.

The control portion includes a control portion (E latch door ECU) provided in the cinching module 2500. The control portion controls the motor 2610 of the latch portion 2000.

When the central lock switch is operated, even when an instruction to open the door is input through the driving state input portion of a certain door, the control portion controls the motor 2610 so that the vehicle door 1 is not opened.

When the central unlock switch is operated, when an instruction to open the door is input through the driving state input portion of the door, the control portion controls the motor 2610 so that the vehicle door 1 is opened.

When the child lock switch is operated, even when an instruction to open the door is input from the driving state input portion of both rear doors, the control portion controls the motor 2610 so that the vehicle door 1 is not opened.

When the child unlock switch is operated, when an instruction to open the door is input from the driving state input portion of both rear doors, the control portion controls the motor 2610 so that the vehicle door 1 is opened.

When the door lock switch is operated, even when an instruction to open the door is input from the driving state input portion of the corresponding door, the control portion controls the motor 2610 so that the vehicle door 1 is not opened.

When the door unlock switch is operated, when an instruction to open the door is input from the driving state input portion of the corresponding door, the control portion controls the motor 2610 so that the vehicle door 1 is opened.

When the dead lock switch is operated, even when an instruction to open the door is input through the driving state input portion provided inside or outside the vehicle door 1, the control portion controls the motor 2610 so that the vehicle door 1 is not opened.

When the dead unlock switch is operated, when an instruction to open the door is input through the driving state input portion provided inside or outside the vehicle door 1, the control portion controls the motor 2610 so that the vehicle door 1 is opened.

Hereinafter, an operation process of the vehicle door latch with a safety device according to the first embodiment of the present invention that has the above-described configuration will be described.

<Safety Actuator Operation Process>

An operation process of the safety actuator is illustrated in detail in FIGS. 12 to 14.

As illustrated in FIG. 12, at ordinary times, the safety actuator may prevent the electronic latch from being operated.

When the safety valve 2630 fitted to the safety motor 2620 is disposed at the left side of the worm 2621, the safety plate 2400 is disposed in a state of being slid rightward due to the safety lever 2640.

Thus, the safety plate detection protrusion 2402 of the safety plate 2400 deviates from a detecting portion of the fourth sensor 2904 and is not detected by the fourth sensor 2904, and the locking fitting portion 2403 is inserted into the safety plate fitting groove 2616 of the locking member 2615.

Since the fourth sensor 2904 is not pressed, power is not supplied to the motor 2610 electrically connected to the fourth sensor 2904, and rotation of the locking member 2615 is mechanically inhibited by the locking fitting portion 2403.

When a user inputs a signal to release the safety device, the safety motor 2620 is operated such that the state illustrated in FIG. 13 is reached.

When the worm 2621 rotates due to the operation of the safety motor 2620, the safety valve 2630 slides rightward. Thus, the safety lever 2640 rotates counterclockwise, and the safety plate 2400 slides leftward.

When the safety plate 2400 slides leftward, the safety plate detection protrusion 2402 of the safety plate 2400 presses the detecting portion of the fourth sensor 2904, thereby being detected by the fourth sensor 2904, and the locking fitting portion 2403 completely deviates from the safety plate fitting groove 2616.

When the safety plate 2400 is detected by the fourth sensor 2904, the safety motor 2620 stops operation, and power is applied to the motor 2610 electrically connected to the fourth sensor 2904.

Here, when the user inputs a signal to open the vehicle door 1, the motor 2610 is operated, and the state illustrated in FIG. 14 is reached.

When the worm 2613 rotates due to the operation of the motor 2610, the worm gear 2614 rotates clockwise, and the locking member 2615 attached to the worm gear 2614 also rotates clockwise. As the locking member 2615 rotates, the first rotation catching portion 2617 pushes the open catching portion 2353 of the open lever 2350 leftward, and the open catching portion 2353 rotates counterclockwise.

Thus, the detecting portion 2352 of the open lever 2350 deviates from the third sensor 2903 and is not detected by the third sensor 2903. Here, the pivoting member catching portion 2351 of the open lever 2350 pushes the lower portion of the pivoting member 2370 rightward such that the latch 2200 is unlocked. When the latch 2200 is unlocked, the latch 2200 rotates counterclockwise due to an elastic force of the first restoring spring 2250, and the vehicle door 1 is opened.

Then, in order to restore the pivoting member 2370 to its default state, the motor 2610 rotates in a reverse direction. When the motor 2610 rotates in the reverse direction, the open lever 2350 rotates counterclockwise due to the second rotation catching portion 2618, the detecting portion 2352 of the open lever 2350 is detected by the third sensor 2903, and, when pressing of the first and second sensors 2901 and 2902 is released, the control portion stops rotation of the motor 2610. Then, in order to return the locking member 2615 to its default state, the motor 2610 rotates a certain amount. Unlike the above description, the open lever 2350 may rotate due to an elastic force of the pivoting member spring 2390 and be restored to its default state.

In this state, when the vehicle door 1 is closed, and a signal to operate the safety device is input in order to prevent operation of the electronic latch by the safety actuator as illustrated in FIG. 12, the safety motor 2620 rotates in a reverse direction.

When the safety motor 2620 rotates in the reverse direction, the safety valve 2630 slides leftward. Thus, the safety lever 2640 rotates clockwise, and the safety plate 2400 moves rightward.

When the state illustrated in FIG. 12 is reached, operation of the electronic latch is mechanically or electrically prevented.

<Opening of Door Using Door Lever Connecting Portion and Door Key Connecting Portion>

Opening of a door using the door lever connecting portion 40 and the door key connecting portion 50 is illustrated in detail in FIGS. 16 and 17.

While the vehicle door 1 is closed such that the state illustrated in FIG. 16 is reached, when a user pulls a lever connected to the door lever connecting portion 40 or inserts a key in the key cylinder and rotates the key, the open plate 2300 connected to the door lever connecting portion 40 and the door key connecting portion 50 slides leftward.

As illustrated in FIG. 17, when the open plate 2300 slides leftward, the open lever 2350 rotates counterclockwise.

When the open lever 2350 rotates counterclockwise, the pivoting member 2370 caught at the pivoting member catching portion 2351 rotates counterclockwise, and the latch 2200 is unlocked. When the latch 2200 is unlocked, the latch 2200 rotates counterclockwise due to the elastic force of the first restoring spring 2250, and the vehicle door 1 is opened.

Since the door lever connecting portion 40 and the door key connecting portion 50 may allow the vehicle door 1 to be manually opened in case of emergency where electronically opening the vehicle door 1 using the motor 2610 is impossible, it is possible to further improve safety of an integrated apparatus for electronic opening and closing of a vehicle door.

<Closing of Door Using Cinching Module>

When the user closes the vehicle door 1 which is in an open state, the striker installed in the vehicle body presses the latch 2200 such that the latch 2200 rotates clockwise.

The latch 2200 rotates clockwise and then presses the first sensor 2901, and the locking portion 2371 of the pivoting member 2370 is inserted into the auxiliary locking groove 2202 of the latch 2200. In this state, when the user stops the operation of closing the vehicle door 1, the vehicle door 1 is incompletely closed. When the user completely closes the vehicle door 1, the latch 2200 is further rotated clockwise and presses the second sensor 2902. When a signal is not received from the second sensor 2902 within a predetermined amount of time after a signal is received from the first sensor 2901, the control portion operates the motor of the actuator 2510 so that the cinching connecting portion 2520 is pulled toward the actuator 2510. As the cinching connecting portion 2520 is pulled, the lever 2530 coupled to the cinching connecting portion 2520 rotates clockwise. When the lever 2530 rotates, the latch 2200 rotates clockwise due to the latch catching portion 2532 of the lever 2530.

Here, although the height of the catching member 2521 of the cinching connecting portion 2520 varies according to rotation of the lever 2530, a bendable cable may be provided as the cinching connecting portion 2520 so that the height variation does not affect rotation of the lever 2530.

The outer circumferential surface of the latch 2200 (that is disposed between the auxiliary locking groove 2202 and the locking groove 2201) pushes the locking portion 2371 of the pivoting member 2370. Therefore, the pivoting member 2370 rotates counterclockwise.

When the vehicle door 1 is completely closed, the locking portion 2371 rotates clockwise due to the pivoting member spring 2390 and is inserted into the locking groove 2201, and the latch 2200 is detected by the second sensor 2902. The control portion receives a signal from the second sensor 2902, stops operation of the actuator 2510, and rotates the actuator 2510 in a reverse direction. The control portion operates the actuator 2510 until the lever 2530 reaches an initial position of the lever 2530 as illustrated in FIG. 26 according to a predetermined stroke inside the actuator 2510. Unlike the above description, a sensor capable of detecting the latch catching portion protrusion 2533 of the lever 2530 may be further provided, and the control portion may control operation of the actuator 2510 by detecting the position of the lever 2530.

Therefore, the lever 2530 is restored to its default position.

Second Embodiment

Unlike in the above-described first embodiment, a vehicle door latch with a safety device according to the second embodiment has a form in which a safety actuator is installed at the exterior of an electronic latch. Thus, the structure of the electronic latch becomes more compact, and it becomes possible to install the safety actuator at a desired position.

Regarding the vehicle door latch with the safety device according to the second embodiment, detailed description of the same structure as that of the above-described first embodiment will be omitted.

A vehicle door latch with a safety device according to the second embodiment includes an electronic latch configured to open a vehicle door or maintain a closed state of the vehicle door, a safety plate 3400 whose one side is connected to the electronic latch and which is configured to mechanically or electrically inhibit operation of the electronic latch, and a safety actuator 1000 connected to another side of the safety plate 3400.

As illustrated in FIGS. 27 and 28, the electronic latch includes a latch portion 3000 and a cinching module 3500.

The latch portion 3000 includes a housing, a latch 3200 pivotally installed at the housing, a pivoting member 3370 configured to lock or unlock the latch 3200, an open lever 3350 configured to rotate the pivoting member 3370, an open plate 3300 configured to rotate the open lever 3350, and a driving portion.

The portion at which the safety actuator is installed according to the first embodiment is not formed in a first housing 3110, a third housing 3150, and an insert plate 3700 according to the second embodiment. Accordingly, the structure on right sides of the first housing 3110, the third housing 3150, and the insert plate 3700 becomes more compact.

Since the structures of the latch 3200, the pivoting member 3370, the open lever 3350, the open plate 3300, and the driving portion are the same as those according to the first embodiment, descriptions thereof will be omitted.

As illustrated in FIG. 29, the safety plate 3400 has a structure in which the structure from the right side end of the safety plate 2400 to the safety plate detection protrusion 2402 according to the first embodiment is omitted. Except for this, the configuration of the safety plate 3400 is the same as that of the safety plate 2400 according to the first embodiment.

A safety connecting portion 1500 configured to connect the safety plate 3400 and the safety actuator 1000 is installed at a left side of the safety plate 3400.

The safety connecting portion 1500 includes a cable 1503 of a wire member such as a wire. An outer circumferential surface of the safety connecting portion 1500 is surrounded by a protective tube. As illustrated in FIG. 34, a fixing portion 1502 having a groove formed around a circumference thereof is formed at one side of the protective tube so as to be fitted and fixed to a safety connecting portion fitting groove 1103 of the safety actuator 1000 which will be described below. As illustrated in FIG. 29, a stopper fixing portion 1506 having the same shape as the fixing portion 1502 is formed at the other side of the protective tube and fitted to a connecting portion cover 3800.

Thus, when the safety connecting portion 1500 moves, the protective tube does not move, and only the cable 1503 moves.

A stopper 1504 of the safety connecting portion 1500 is fitted to a stopper fitting groove 3411, and a left-right length of the stopper fitting groove 3411 is formed to be larger than a left-right length of the stopper 1504 so that the stopper 1504 may slide in the left-right direction. Thus, even when the cable 1503 is bent and thus the stopper 1504 moves or when a stroke error occurs during assembly of the safety connecting portion 1500, it is possible to actively deal with such situations.

The cable 1503 of the safety connecting portion 1500 is installed at a stopper catching portion 3412. A front-rear width of the stopper catching portion 3412 is formed smaller than a front-rear length of the stopper 1504 so that the stopper 1504 is prevented from falling off to the left side from the stopper fitting groove 3411.

A stopper spring 1505 of the safety connecting portion 1500 is installed at a spring fitting portion 3413.

The safety actuator 1000 is illustrated in detail in FIGS. 33 and 34.

The safety actuator 1000 includes a front cover 1100, a rear cover 1200 bolted and coupled to the rear of the front cover 1100, and a safety driving portion installed in an inner space between the front cover 1100 and the rear cover 1200.

The front cover 1100 is formed in a rectangular parallelepiped shape having an open rear portion as a whole.

The safety connecting portion fitting groove 1103 into which the safety connecting portion 1500 is inserted is formed at an upper portion of a right side of the front cover 1100.

The safety connecting portion fitting groove 1103 is formed so as to be open leftward, rightward, and rearward. A plate crossing the safety connecting portion fitting groove 1103 in the up-down direction is formed at the center thereof so as to protrude to the rear. A groove is formed in the plate so as to be open rearward so that the fixing portion 1502 of the safety connecting portion 1500 may be fitted thereto. Thus, the fixing portion 1502 is prevented from moving in the left-right direction.

A safety motor installation portion 1101 into which a safety motor 1400 is inserted is formed at a lower portion of the right side of the front cover 1100.

A groove is formed in a left side and a right side of the safety motor installation portion 1101 so that a shaft of the safety motor 1400 may be fitted thereto.

Guide portions 1102*a* and 1102*b* are formed longitudinally in the left-right direction at an upper portion and a lower portion of a left side of the front cover 1100 so as to protrude to the rear. Although not illustrated, like the guide portion 1102*b* formed at a lower portion, the guide portion 1102*a* formed at an upper portion is formed as a pair of guide portions 1102*a* in the up-down direction.

A bolt fastening portion 1104 is formed at left and right sides of an upper surface and a lower surface of the front cover 1100 so as to protrude to the outside. A hole is formed in the bolt fastening portion 1104 so as to be penetrated in the front-rear direction, and the bolt fastening portion 1104 may be bolted and fastened to the rear cover 1200 through the hole.

The rear cover 1200 is formed in a rectangular parallelepiped shape having an open front portion as a whole.

A groove corresponding to the safety connecting portion fitting groove 1103 of the front cover 1100 is formed in an upper portion of a right side surface of the rear cover 1200.

A protrusion 1201 is formed longitudinally in the left-right direction at an upper portion of a left side of the rear cover 1200 so as to protrude to the front. The protrusion 1201 is formed in plurality in the up-down direction. When a safety valve 1450, which will be described below, slides in the left-right direction, the protrusions 1201 cause the safety valve 1450 to come into line contact with the rear cover 1200, thereby minimizing friction force. Also, an interval between the protrusions 1201 is formed to be smaller than a diameter of a catching protrusion 1501 of the safety connecting portion 1500, that will be described below, so that the catching protrusion 1501 is prevented from falling off to the rear.

A bolt fastening portion 1202 is formed at left and right sides of an upper surface and a lower surface of the rear cover 1200 so as to protrude to the outside. The bolt fastening portion 1202 is formed at a position corresponding to that of the bolt fastening portion 1104 of the front cover 1100. A hole is formed in the bolt fastening portion 1202 so as to be penetrated in the front-rear direction, and the bolt fastening portion 1202 may be bolted and fastened to the front cover 1100 through the hole.

A wire connecting portion 1203 is formed at a lower portion of a right side of a rear surface of the rear cover 1200 so as to protrude to the rear. A hole (not illustrated) is formed in the wire connecting portion 1203 so as to be penetrated in the front-rear direction. Thus, a wire 3750 may be connected to the safety motor 1400 inside the safety actuator 1000 through the wire connecting portion 1203 from the outside.

A sealing member 1300 may be further included between the front cover 1100 and the rear cover 1200. Thus, the safety driving portion is prevented from being damaged due to water. The sealing member 1300 is not formed at a portion in which the safety connecting portion 1500 is inserted into the safety actuator 1000.

The safety driving portion includes the safety motor 1400, a worm 1401 rotated by the safety motor 1400, and the safety valve 1450 configured to slide in the left-right direction by the worm 1401.

The worm 1401 is installed at the shaft of the safety motor 1400.

The safety valve 1450 is formed in an L-shape as a whole.

A female screw portion 1453 fitted to the worm 1401 is formed at a lower portion of the safety valve 1450 so as to be penetrated in the left-right direction. The female screw portion 1453 is engaged with the worm 1401.

An upper portion of the safety valve 1450 is formed so as to be open rearward.

A cable installation groove 1451 into which the cable 1503 of the safety connecting portion 1500 is inserted is formed at a right side of a rear surface of the upper portion of the safety valve 1450 so as to be open rearward. A groove is formed at left and right sides of the cable installation groove 1451 so as to be open rearward and be penetrated in the front-rear direction so that the cable 1503 may pass therethrough.

A catching protrusion installation groove 1452 into which the catching protrusion 1501 formed at an end of the cable 1503 of the safety connecting portion 1500 is inserted is formed at a left side of a rear surface of the upper portion of the safety valve 1450. A right side of the catching protrusion installation groove 1452 comes into communication with a left side of the cable installation groove 1451.

An up-down width of the groove formed at the left and right sides of the cable installation groove 1451 is formed to be larger than a diameter of the cable 1503 and smaller than a diameter of the catching protrusion 1501 so that a phenomenon in which the catching protrusion 1501 falls off to the left side from the catching protrusion installation groove 1452 is prevented.

The rear of the safety valve 1450 is blocked by the rear cover 1200.

A sliding valve 1454 is formed longitudinally in the left-right direction at a front surface of the upper portion of the safety valve 1450 so as to protrude to the front. A single sliding valve 1454 is formed at each of upper and lower sides of the front surface.

The sliding valve 1454 formed at an upper portion is inserted between the guide portions 1102*a* at the upper portion of the front cover 1100, and the sliding valve 1454 formed at a lower portion is inserted between the guide portions 1102*b* at the lower portion of the front cover 1100.

Thus, when the worm 1401 rotates, the safety valve 1450 does not rotate and slides in the left-right direction.

An operation process of the safety actuator 1000 is illustrated in detail in FIGS. 30 to 34.

As illustrated in FIG. 30, at ordinary times, the safety actuator 1000 may prevent the electronic latch from being operated.

When the safety valve 1450 fitted to the safety motor 1400 is disposed at the right side of the worm 1401, since the cable 1503 of the safety connecting portion 1500 is not pulled, the safety plate 3400 connected to the safety connecting portion 1500 is disposed in a state of being slid rightward.

Thus, a safety plate detection protrusion 3402 of the safety plate 3400 deviates from a detecting portion of a fourth sensor 3904 and is not detected by the fourth sensor 3904, and a locking fitting portion 3403 is inserted into a safety plate fitting groove 3616 of a locking member 3615.

Since the fourth sensor 3904 is not pressed, power is not supplied to a motor 3610 electrically connected to the fourth sensor 3904, and rotation of the locking member 3615 is mechanically inhibited by the locking fitting portion 3403.

When a user inputs a signal to release the safety device, the safety motor 1400 is operated such that the state illustrated in FIG. 31 is reached.

When the worm 1401 rotates due to the operation of the safety motor 1400, the safety valve 1450 slides leftward. When the safety valve 1450 slides leftward, the catching protrusion 1501 of the safety connecting portion 1500 installed at the safety valve 1450 moves leftward such that the cable 1503 moves leftward. When the cable 1503 moves leftward, the stopper 1504 installed at the opposite side of the catching protrusion 1501 at the cable 1503 also moves leftward, and the safety plate 3400 at which the stopper 1504 is installed slides leftward.

When the safety plate 3400 slides leftward, the safety plate detection protrusion 3402 of the safety plate 3400 presses a detecting portion of the fourth sensor 3904 and is detected by the fourth sensor 3904, and the locking fitting portion 3403 completely deviates from the safety plate fitting groove 3616.

When the safety plate 3400 is detected by the fourth sensor 3904, the safety motor 3620 stops operation, and power is applied to the motor 3610 electrically connected to the fourth sensor 3904.

Here, when the user inputs a signal to open the vehicle door 1, the motor 3610 is operated, and the state illustrated in FIG. 32 is reached.

A process in which the door is opened is the same as in the first embodiment.

When the vehicle door 1 is closed, and a signal to operate the safety actuator 1000 is input in order to prevent operation of the electronic latch by the safety actuator 1000 as illustrated in FIG. 30, the safety motor 1400 rotates in a reverse direction.

When the safety motor 1400 rotates in the reverse direction, the safety valve 1450 slides rightward. Thus, when the tension on the safety connecting portion 1500 disappears, the safety plate 3400 moves rightward due to the stopper spring 1505.

When the state illustrated in FIG. 30 is reached, operation of the electronic latch is mechanically or electrically prevented.

Processes of opening a door using the door lever connecting portion 40 and the door key connecting portion 50 and closing the door using the cinching module 3500 according to the second embodiment are the same as in the first embodiment.

The present invention has been described above with reference to the exemplary embodiments thereof, but those of ordinary skill in the art may modify or change the present invention in various ways within the scope not departing from the idea and range of the present invention described in the claims below.

DESCRIPTION OF REFERENCE NUMERALS

1: vehicle door,
2: touch sensor

35: stopper spring,
40: door lever connecting portion
43: cable,
44: stopper
45: stopper spring,
46: stopper fixing portion
50: door key connecting portion,
53: cable
54: stopper,
55: stopper spring
56: stopper fixing portion
2000: latch portion,
2103: third guide portion
2104: third housing fitting portion
2105: striker insertion groove
2106: shaft,
2107: first open lever guide portion
2108: second open lever guide portion,
2109: safety lever shaft
2110: first housing,
2111: latch installation groove
2112: motor installation portion,
2113: spring insertion groove
2114: lever shaft,
2115: catching portion guide groove
2116: pivoting member installation groove
2117: spring insertion groove
2118: pivoting member catching portion through-hole
2119: cinching connecting portion installation portion
2120: safety motor installation portion,
2121: first fastening portion
2122: guide boss,
2123: bumper member insertion groove
2124: door installation portion,
2125: first guide portion
2126: first connecting portion cover installation portion
2127: second guide portion
2128: second connecting portion cover installation portion
2129: sensor transfer member insertion portion
2130: second housing,
2133: bolt fastening portion
2134: door installation portion,
**2134*a***: installation boss
2135: first protruding portion,
2136: second protruding portion
2137: third protruding portion,
2140: sealing member
2150: third housing,
2151: first housing fitting portion
2152: fourth protruding portion,
**2153*a***: fifth protruding portion
**2153*b***: lever guide portion,
**2154*a***: wire connecting portion
**2154*b***: wire through-groove,
2155: second fastening portion
2156: connecting portion cover installation groove
2157: connecting portion cover support portion
2158: first housing insertion groove
**2159*a***: connecting portion through-groove
**2159*b***: connecting portion through-groove
2200: latch,
2201: locking groove
**2201*a***: second locking catching portion
2202: auxiliary locking groove
**2202*a***: first locking catching portion,
2203: first surface
2204: striker catching protrusion,
2205: second surface
2206: elastic cover,
2207: third surface
2208: elastic cover groove,
2209: slit
2213: spring fitting portion,
2215: protrusion
2230: latch pivoting shaft,
2250: first restoring spring
2251: first restoring spring catching shaft
2252: first bent portion
2253: second bent portion
2300: open plate,
2301: cover fitting portion
2302: curved portion,
2303: open lever fitting portion
2304: open lever fitting groove,
2310: stopper installation portion
2311: stopper fitting groove,
2312: stopper catching portion
2313: spring fitting portion
2350: open lever,
2351: pivoting member catching portion
2352: detecting potion,
2353: open catching portion
2354: open catching protrusion
2360: bumper member
2370: pivoting member,
2371: locking portion
2372: latch insertion groove,
2373: catching protrusion
2374: elastic cover,
2375: spring fitting portion
2376: slit,
2380: pivoting shaft
2390: pivoting member spring
2391: pivoting spring catching shaft
2392: first bent portion,
2393: second bent portion
2400: safety plate,
2401: cover fitting portion
2402: safety plate detection protrusion
2403: locking fitting portion
2404: safety lever fitting portion
2410: stopper installation portion
2411: stopper fitting groove,
2412: stopper catching portion
2413: spring fitting portion
2500: cinching module,
2510: actuator
2520: cinching connecting portion,
2521: catching member
2522: fixing portion,
2530: lever
2531: catching member fitting portion,
2532: latch catching portion
2533: latch catching portion protrusion,
2534: lever protrusion
2535: insertion hole
2610: motor,
2613: worm
2614: worm gear,
2615: locking member
2616: safety plate fitting groove
2617: first rotation catching portion
2618: second rotation catching portion

2620: safety motor,
2621: worm
2630: safety valve,
2631: sliding valve
2632: female screw portion,
2633: safety lever fitting portion
2640: safety lever
2700: insert plate,
2701: first-and-second sensor installation portion
2702: first-and-second sensor installation valve
2703: third sensor installation portion
2704: fourth sensor installation portion
2705: fourth sensor fitting protrusion
2706: fourth sensor support portion
2707: third fastening portion
2708: shaft through-groove,
2710: open plate installation groove
2711: open plate through-groove,
2712: open plate support portion
2713: open plate guide portion,
2714: safety plate through-groove
2715: safety plate support portion,
2720: motor installation portion
2721: motor shaft support portion
2730: safety motor installation portion
2731: fourth guide portion,
2740: wire connecting portion
2750: wire
2800: connecting portion cover,
2801: catching groove
2802: safety plate guide groove,
2803: open plate guide groove
2804: first connecting portion seating groove
2805: second connecting portion seating groove
2806: connecting portion through-groove
2807: fixing portion installation groove
2808: cable through-groove
2809: housing interference prevention groove
2901: first sensor,
2902: second sensor
2903: third sensor,
2904: fourth sensor
2911: first sensor transfer member
2912: second sensor transfer member
1000: safety actuator
1100: front cover,
1101: safety motor installation portion
1102*a*: guide portion,
1102*b*: guide portion
1103: safety connecting portion fitting groove
1104: bolt fastening portion
1200: rear cover,
1201: protrusion
1202: bolt fastening portion,
1203: wire connecting portion
1300: sealing member
1400: safety motor,
1401: worm
1450: safety valve,
1451: cable installation groove
1452: catching protrusion installation groove
1453: female screw portion
1454: sliding valve
1500: safety connecting portion,
1501: catching protrusion
1502: fixing portion,
1503: cable
1504: stopper,
1505: stopper spring
1506: stopper fixing portion

The invention claimed is:

1. A vehicle door latch with a safety device, the vehicle door latch comprising:

an electronic latch configured to open a vehicle door or maintain a closed state of the vehicle door;

a safety plate whose one side is connected to the electronic latch and which is configured to mechanically or electrically inhibit operation of the electronic latch; and a safety actuator connected to another side of the safety plate, wherein, when the safety plate moves due to operation of the safety actuator, power is applied to the electronic latch, and the electronic latch is mechanically operated, wherein the safety actuator includes:

a safety motor;

a worm configured to be rotated by the safety motor;

a safety valve coupled to the worm; and a safety lever being coupled to the safety valve, wherein a safety lever fitting portion of the safety valve is inserted into and coupled to a hole formed in a wing portion of the safety lever, and a safety lever fitting portion of the another side of the safety plate is inserted into and coupled to a hole formed in another wing portion of the safety lever, wherein when the safety motor rotates and the worm rotates, the safety valve slides in the left-right direction instead of being rotated and the safety lever rotates.

2. The vehicle door latch of claim 1, wherein the safety actuator is embedded in the electronic latch.

3. The vehicle door latch of claim 2, wherein the electronic latch further comprises a cable whose one side is connected to the electronic latch and whose other side is connected to a handle.

4. The vehicle door latch of claim 1, wherein:

the safety actuator is installed at an exterior of the electronic latch; and the safety plate further comprises a safety cable whose one side is connected to the safety plate and whose other side is connected to the safety actuator.

5. The vehicle door latch of claim 4, wherein the other side of the safety cable is able to be connected to a handle after the safety actuator is removed from the safety cable.

6. The vehicle door latch of claim 1, wherein, at an outer side of the vehicle door, a handle is not installed, and a pressing switch or a touch input portion is formed.

* * * * *